US011618271B2

(12) United States Patent
Sahun Peres et al.

(10) Patent No.: US 11,618,271 B2
(45) Date of Patent: Apr. 4, 2023

(54) INK-JET PRINT HEADS PROTECTING SYSTEM IN A DIGITAL PRINTING MACHINE

(71) Applicant: COMEXI GROUP INDUSTRIES, S.A.U., Riudellots de la Selva (ES)

(72) Inventors: Jordi Sahun Peres, Bordils (ES); Lluis Turon Castello, Sant Gregori (ES); Andreu Rosales Perez, Blanes (ES); Joaquim Quintana Vila, Vidreres (ES)

( * ) Notice: Subject to any disclaimer, the term of this patent is extended or adjusted under 35 U.S.C. 154(b) by 0 days.

(21) Appl. No.: 17/285,190

(22) PCT Filed: Sep. 26, 2019

(86) PCT No.: PCT/EP2019/076051

§ 371 (c)(1),
(2) Date: Apr. 14, 2021

(87) PCT Pub. No.: WO2020/074266

PCT Pub. Date: Apr. 16, 2020

(65) Prior Publication Data

US 2022/0048298 A1 Feb. 17, 2022

(30) Foreign Application Priority Data

Oct. 17, 2018 (EP) ..... 18382741

(51) Int. Cl.
*B41J 2/21* (2006.01)
*B41J 25/308* (2006.01)
*B41J 25/00* (2006.01)

(52) U.S. Cl.
CPC ..... *B41J 25/003* (2013.01); *B41J 2/2146* (2013.01); *B41J 25/3088* (2013.01)

(58) Field of Classification Search
CPC .. B41J 25/308; B41J 25/3082; B41J 25/3086; B41J 25/3088; B41J 3/54; B41J 3/543; B41J 2/165; B41J 2002/165
See application file for complete search history.

(56) References Cited

U.S. PATENT DOCUMENTS

2002/0001006 A1* 1/2002 Matsumoto ..... B41J 11/008 347/136
2003/0116041 A1* 6/2003 Manes ..... B41J 11/20 101/198
2005/0012774 A1 1/2005 Izawa et al.
(Continued)

FOREIGN PATENT DOCUMENTS

JP 2010058431 A 3/2010
JP 2017013237 A 1/2017

*Primary Examiner* — Scott A Richmond
(74) *Attorney, Agent, or Firm* — Eugenio J. Torres-Oyola; Victor M. Rodriguez-Reyes; Rafael Rodriguez-Muriel

(57) ABSTRACT

The present invention relates to an ink-jet print heads protecting system in a digital printing machine, wherein the module comprises a chassis (1), rollers (2), and a plurality of digital printing units (10), each with a bridge (11) with guides (12) and a sliding carriage (13) with ink-jet print heads (14), one part of each guide overlapping the band and another part projecting beyond the band path, the carriage being movable between the printing and maintenance positions; and in that each bridge is attached to the chassis by of a position adjustment device (20) and an articulation (25) that are spaced apart or by two position adjustment devices (20) that are spaced apart.

7 Claims, 12 Drawing Sheets

(56) References Cited

U.S. PATENT DOCUMENTS

| | | | | |
|---|---|---|---|---|
| 2008/0238995 | A1 | 10/2008 | Menendez et al. | |
| 2010/0053259 | A1 | 3/2010 | Groenenboom et al. | |
| 2010/0188468 | A1 | 7/2010 | Herpel et al. | |
| 2011/0043554 | A1 | 2/2011 | Silverbrook et al. | |
| 2011/0149004 | A1 | 6/2011 | Ray et al. | |
| 2013/0100207 | A1 | 4/2013 | Van Der Zwan | |
| 2015/0290919 | A1* | 10/2015 | Carson | B32B 38/0004 156/249 |
| 2016/0075154 | A1 | 3/2016 | Häcker et al. | |
| 2017/0313109 | A1* | 11/2017 | Profaca | B41J 2/16544 |
| 2017/0320341 | A1* | 11/2017 | Wander | B41J 15/046 |
| 2021/0286563 | A1* | 9/2021 | Albright | G06F 3/1204 |

* cited by examiner

INK-JET PRINT HEADS PROTECTING SYSTEM IN A DIGITAL PRINTING MACHINE

FIELD OF THE ART

The present invention relates to an ink-jet print heads protecting system in a digital printing machine for printing a band of continuous sheet material, which allows printing on said band of continuous sheet material by using ink-jet printing heads and prevents the damaging of said ink jet print heads when a thickening of the band of sheet material reaches the printing segments where the printing is performed by the ink-jet print heads.

A digital printing machine may integrate an unwinding module, a winding module, an ink dying or curing module, an offset printing module, rotogravure printing, etc, a laminating module, a stamping module, a laser perforation or cutting module, a folding module, etc.

Ink-jet printing heads are understood to be those heads which eject microdroplets of ink on the band of sheet material in exact positions as the band of continuous sheet material moves ahead of said ink jet printing heads, thereby achieving precise, multicolor digital printing without the ink jet print heads having to contact the band of sheet material.

STATE OF THE ART

Digital printing modules which can be integrated in printers for printing bands of continuous sheet material are known.

For example, patent document US20170313109 which describes one of these units is known, and according to this document, the digital printing module consists of multiple printing units arranged transverse to the printing band, each provided with multiple ink-jet print heads. The ink-jet print heads are mounted on a carriage which can move in a perpendicular direction with respect to the band of sheet material, moving away from same for the maintenance thereof. However, this solution makes it difficult to access the ink jet print heads which are located between other printing units and above the band of sheet material difficult.

Patent document US20160075154 describes a solution that is similar to the preceding one and has similar problems.

Patent document US20110043554 is also known and it describes a plurality of digital printing units mounted on a sliding carriage movable in a transverse direction with respect to the band path of the band of sheet material, which thereby allows placing all the printing units in a printing position in which the corresponding ink-jet print heads are arranged opposite the band of sheet material, or in a maintenance position in which the ink jet print heads are not arranged opposite the band of sheet material, but rather moved to one side thereof, making the maintenance thereof easier. However, this solution does not allow operating the digital printing module while maintenance is being performed as individual maintenance of a digital printing unit cannot be carried out while the rest of the digital printing units are in operation.

On the other hand, patent documents US20030116041 and US20170320341 are also known, and they both describe a digital printing module in which the band of sheet material is supported on a plurality of rollers arranged defining an arcuate band path arranged opposite digital printing units, said plurality of rollers being movable in a swiveling manner in a direction in which they move away from the digital printing units, which thereby allows the entry of an operator to perform inspection and maintenance of the ink jet print heads of the digital printing units. This solution does not allow performing maintenance and printing tasks simultaneously.

Document US2013100207A1 describe a digital printing machine in which the printing units include a bridge with guides in the transverse direction in regard to the conveyance direction of the band of sheet material, where a sliding carriage supporting the ink jet print heads permits the lateral movement of the ink jet print heads to a position non-opposed to the band of sheet material, but said ink jet print heads are connected to said carriage further includes a displacement device to permit the movement of the ink jet print heads in the perpendicular direction in regard to the band of sheet material to increase the distance therebetween. This particular solution where the ink-jet print heads are connected to a displacement device, which is connected to a carriage which is connected to a guides produces an easy misalignment of the ink-jet print heads because each one of said connections have tolerances.

The aforementioned documents neither prevent the damaging or misalignment of the ink jet print heads if a thickening of the band of sheet material passes through the printing segments nor allows a precise, independent position adjustment of each printing unit to assure the correct alignment and distance thereof, nor do they propose solutions for possible misalignments caused during the manual or automatic maintenance tasks.

BRIEF DESCRIPTION OF THE INVENTION

The present invention relates to an ink-jet print heads protecting method and system in a digital printing machine.

It will be understood that a digital printing machine can integrate different modules, such as a winding or unwinding module, a laminating module, etc.

Digital printing is that printing performed by ink jet print heads which eject microdroplets of ink on the band of sheet material when it circulates ahead of the ink-jet print head. The precise control of the speed of movement of the band of continuous sheet material, together with the precise control of the moments of ejection of each microdroplet of ink allow printing any motif contained in a digital file.

A simple modification of the mentioned digital file will allow modifying the motif to be printed without requiring any mechanical change in the digital printing module.

According to a first aspect, the present invention relates to an ink jet print heads protecting method in a digital printing machine. The method comprises the following steps which are already known from the state of the art documents:

a printing step in which a band of sheet material is printed by ejecting ink from the ink jet print heads on printing segment of said band of sheet material while said band of sheet material is conveyed in a direction of conveyance along a band path, supported and guided in a taut manner on one or more supports and while the supports, the band of sheet material and the ink jet print heads are in a printing position in which the ink jet print heads are arranged orthogonal to and spaced apart less than 5 mm from a printing segment of the band of sheet material overlapped or adjacent to said one or more supports.

According to that, during the printing step the ink-jet print heads are facing printing positions of the band of sheet material at a distance lower than 5 mm while ejecting ink thereon and while the band of sheet material is being moved in the conveyance direction in a taut manner on the supports, defining a band path.

The present method further comprises the following steps, which are not known from the available state of the art documents:

an awareness step, performed during the printing step, in which the presence of a thickening in a first position of the band of sheet material upstream of the printing segments facing ink jet print heads is determined; and a protection step, initiated in response to the determination of the presence of a thickening performed during the awareness step and previous to the pass of the thickening through said printing segment, in which at least one of said on one or more supports adjacent or coincident with said printing segment is/are moved from the printing position to a secure position, producing an increase of the distance between the band of sheet material supported on said support and the ink-jet print heads while the thickening is upstream of the printing segment.

According to that during printing step an awareness step is performed, in which the presence of a thickening of the band of sheet material can be determined in a first position upstream of the ink jet print heads, i.e. in a portion of the band of sheet material which, conveyed in the conveyance direction, has yet to reach the ink jet print heads.

It will be understood that a thickening is an increase in the thickness of the band of sheet material affecting only a portion of the band of sheet material. Said thickening can be produced for example by a splice of the band of sheet material, by the adhesion of a tag or similar element to the band of sheet material, an embossing of the band of sheet material or to a defect in the band of sheet material such a wrinkling and/or a breakage of the band of sheet material.

During the printing step the ink jet print heads are spaced apart but in a close distance from the band of sheet material. A thickening of said band of sheet material can produce its contact with the ink jet print heads damaging or misaligning said ink-jet print heads, therefore if the presence of a thickening is determined upstream of the ink jet print heads during the awareness step, said distance shall be increased to allow a safe pass of the thickening through the printing segment.

The precision in the position of said ink-jet print heads is essential to assure the printing quality, therefore it is proposed to, during the protecting step, move said one or more supports on which the band of sheet material is guided and supported in a taut manner away from the ink-jet print heads increasing the distance therebetween.

When said one or more supports are moved, the band path defined thereon is also moved and the band of sheet material changes its position following the movement of said one or more supports increasing its distance with the ink-jet print heads, in advance to the thickening of the band of sheet material passing in front the ink jet print heads. This solution prevents the contact of the thickening of the band of sheet material with the ink-jet print heads.

The distance between the band of sheet material and the ink jet print heads, when in the secure position, will be bigger than 5 mm, preferably bigger than 20 mm.

As an option, it is also proposed to move said one or more supports from the printing position to the secure position also when the printing step is finished, interrupted, or when the band of sheet material is split by tearing so that when the band of sheet material does not move in the conveyance direction said one or more supports are in the secure position, preventing damaging of the ink-jet print heads while the printing is stopped.

An accidental transversal tearing of the band of sheet material can produce a complete split of the band of sheet material. Said split of the band can be detected, for example, by an unexpected and sudden alteration in the tension of the band of sheet material, which can be detected by a band tension detector, or by other systems.

According to another embodiment of the present invention, the protection step further comprises, while the supports are in the secure position, lineally moving multiple of said ink jet printing heads grouped in a printing unit in a transverse direction, from a position opposed to a printing segment to a maintenance position in which the ink-jet print heads are arranged in a position non-opposed to the band path, on one side of the printing segment, said transverse direction being tangent to the respective printing segment and perpendicular to the direction of conveyance.

According to this embodiment multiple ink-jet print heads are grouped in printing units, and can be moved together in a linear transverse direction from a position in which the ink jet print heads are facing the band path to a maintenance position in which said ink-jet print heads are not facing the band path, being the ink-jet print heads accessible from bellow for maintenance.

Said movement in a linear transverse direction is a straight movement in a linear stroke in a direction perpendicular to the conveyance movement of the band of sheet material, and tangent to said band of sheet material in the printing segment related with the corresponding ink jet print heads, or including an ascendant inclination from that direction, for example of 10°. A linear movement in a straight stroke.

Thanks to this movement of the ink-jet print heads in the linear transverse direction, the ink jet print heads are totally removed from the vertical projection of the band path, so that a big size thickening, for example a wrinkling of the sheet material due to a partial breakage thereof, cannot damage the ink jet print heads.

In this case, it is also proposed that once the multiple ink jet printing heads of a printing unit are in the maintenance position, one hermetic closure cover is attached to said printing unit hermetically enclosing said ink-jet print heads to prevent the ink therein from drying up.

The attachment of said hermetic closure cover to the printing unit will be preferably produced by an ascendant movement of said hermetic closure cover.

The determination of the presence of a thickening of the band of sheet material described above can be produced by a thickening presence signal generated by:

- a thickener device configured to create a thickening in the first position of the band of sheet material, generating the thickening presence signal; and/or
- a thickening detector configured to detect a thickening in the first position of the band of sheet material, generating the thickening presence signal; and/or
- a metering device configured to determine a correspondence between a given portion of the band of sheet material (4) placed in the first position and a pre-stored thickening position data, generating the thickening presence signal.

Said thickener device can be, for example, an automatic splicing device which adhere one final end of one partial band of sheet material with one initial end of another successive partial band of sheet material to create the continuous band of sheet material. In an alternative embodiment the thickener device can be an automatic tag adhering device which adhere tags on specific locations of the band pf sheet material or an automatic embossing device which creates a relief on the band of sheet material.

The thickening detector can be, for example, an optical detector directed towards the band of sheet material, a thickness meter for metering the thickness of the band of sheet material or a roughness detector in contact with at least one face of the band of sheet material.

The present method also proposes that a conveying time of the band of sheet material between the first position and the printing segments is known and the protection step is initiated during a final fraction of said conveying time, i.e. that the time required to convey a thickening from the first position to the in jet printing heads is known, and that the increase in the separation between the printing segments and the correspondent ink-jet printing heads starts only in a final fraction of said conveying time, for example in the last half, or the last quarter of said time, to reduce the wasting of band of sheet material.

Preferably, once the thickening has passed through the printing segments and is placed downstream of the ink jet print heads the one or more supports return to the printing position moving back the band of sheet material to said printing position, returning to the printing step.

It is also proposed to adjust the velocity of conveyance of the band of sheet material during the protection step in response to the thickening presence signal produced during the awareness step to reduce the velocity of the band of sheet material while the thickening remains upstream of the printing segments, returning to the normal velocity of conveyance once the thickening is placed downstream the printing segments.

Optionally, while the band of sheet material is not in the printing position the ejection of ink from the ink-jet print heads is interrupted, to avoid ink wasting.

It is also proposed that the printing position of the supports is adjusted considering the thickness of the band of sheet material to keep a predefined minimal distance between the surface of the band of sheet material and the ink-jet printing heads on the printing segments, i.e. when the band of sheet material is thick the printing position of the supports is more distant from the ink-jet printing heads than when the band of sheet material is not so thick, so that the distance between the surface of the band of sheet material and the ink-jet printing heads is the same in both cases. The thickness of the sheet material can be stored in the control unit or detected by sensors.

Furthermore, the presence of a rubbing printing defect and/or of an ink-jet obturation printing defects in the freshly printed band of sheet material can be determined downstream of the ink-jet print heads. In response to the determined presence of rubbing printing defects and/or of ink-jet obturation printing defects the first sub-chassis will be moved away from the ink jet print heads and/or the printing units will be moved from a position opposed to a printing segment to the maintenance position.

The rubbing printing defect are defects observable in the printed surface of the band of sheet material produced when a freshly printed ink deposited on the surface of the band of sheet material suffers smearing by rubbing said freshly printed surface conveyed in the conveyance direction with some static element of the printing machine facing the freshly printed surface of the band of sheet material. Typically said static element of the printing machine is an ink-jet printing head because are close to said freshly printed surface of the band of sheet material.

The ink-jet obturation printing defects are defects observable in the printed surface of the band of sheet material produce when one or multiple ink-jet printing heads are dirty or obturated, reducing or preventing the ejection of ink from this particular ink-jet printing head producing an area of the band of sheet material with less or no ink of a particular color on it.

When one of those rubbing printing defects or ink-jet obturation printing defects are detected, the distance between the supports and the ink jet print heads is increased to solve this problem and to protect the ink jet printing heads by moving the support away from the ink jet printing heads and/or by moving the ink-jet printing heads to the maintenance position. Furthermore, when the ink jet printing heads are in the maintenance position a cleaning operation can be performed on said ink jet printing heads to solve the detected problem.

According to an additional embodiment of the present method it is proposed to determine:

which color freshly printed on the surface of the band of sheet material includes the rubbing printing defects and/or the ink-jet obturation printing defects;

which ink-color is printed by the ink-jet print heads of each printing unit; and in which printing unit the rubbing printing defects and/or ink jet obturation printing defects have been produced by associating information on which freshly printed color include defects and which ink-color is printed by each printing unit, and wherein said first actuator and/or the second actuator are activated to move the first sub-chassis away from the ink-jet print heads, and/or to move printing units from a position opposed to a printing segment to the maintenance position in response to the determination of the presence of rubbing printing defects and/or ink jet obturation printing defects.

In other words, it can be determined which particular printing unit produces the rubbing printing defect or the ink-jet obturation defect by detecting the freshly printed color in which the defect is produced and by knowing which color is printed by each printing unit.

When the detected defect is an ink-jet obturation defect, it is clear that the missing color in the freshly printed surface of the band of sheet material is caused by the ink jet printing head responsible to print said color.

When the detected defect is a rubbing printing defect, a printing unit contacting with the freshly printed surface of the band of sheet material will produce the defect in all the colors printed by printing units placed upstream, but not in the colors printed by printing units placed downstream, therefore it will be easy to determine which printing unit is responsible by detecting which freshly printed colors are affected by the defect and which are not.

All those operations can be automatically performed by the control unit analyzing images captured from the surface of the band of sheet material, for example by an image detector, for example a camera or a video camera, said control unit storing information relative to which printing unit is printing which each color.

According to a second aspect, the present invention is directed to an ink-jet printing heads protecting system for a digital printing machine. This system comprises, as it is known in the existing state of the art:

a chassis including a first sub-chassis supporting one or more supports and a second sub-chassis supporting ink jet print heads, wherein said supports define a band path in which a band of sheet material is supported and guided in a taut manner and conveyed in a direction of conveyance, and wherein said ink-jet print heads are arranged orthogonal to and spaced apart less than 5 mm from a printing segment of the band of sheet material when the band of sheet material is in a printing position, and wherein the first sub-chassis is movable between the printing position and a secure position in which the distance between the printing segments and the ink jet print heads is bigger than in the printing position, being the first sub-chassis actuated by a first actuator.

In other words, the proposed system integrates in a chassis one or more supports, supporting a continuous band of flexible material in a taut manner.

Said band path includes a succession of printing segments of the band of sheet material, each printing segment being arranged opposite a digital printing unit provided with ink jet print heads provided for projecting microdroplets of ink on the portion of the conveyed band of sheet material which in that moment is in said printing segment opposite said ink jet print heads.

Upstream to the printing segments it is proposed to include a band tensioning device configured to adjust and maintain the tension of the band of sheet material, said tensioning device typically comprising a couple of rollers defining a nip in-between coincident with the band path, said couple of rollers being movable to adjust its position, increasing or decreasing the longitude of the band path.

Said band tensioning device shall be places as close to the printing segments as possible, therefore it is preferred to include said band tensioning device between the first position where the presence of a thickening is determined and the printing segments.

Preferably said band tensioning device is placed in a position lower than the printing segments, and the ink-jet print heads are placed above the printing segments, the band of sheet material receiving the ink from above. In a preferred embodiment the printing segments are followed by a drying unit where the freshly printed ink is dried. An additional band tensioning device can be placed downstream the drying unit.

Said band path will allow defining, in each printing segment, three orthogonal directions, i.e., a transverse direction, a longitudinal direction, and a perpendicular direction, orthogonal to one another, the perpendicular direction being that direction perpendicular to the printing segment, the longitudinal direction being that direction tangent to the band path and parallel to the direction of conveyance in the corresponding printing segment, i.e., the longitudinal direction will be tangent to the band of sheet material and coincide with the conveyance direction in each printing segment, a transverse direction parallel to said roller axes and coplanar with the band of sheet material in each printing segment.

The present system further comprises, in a manner not known in the known documents of the state of the art:

a thickener device configured to create a thickening in the first position of the band of sheet material, generating a thickening presence signal; and/or a thickening detector configured to detect a thickening in the first position of the band of sheet material, generating a thickening presence signal; and/or a metering device configured to determine a correspondence between a given portion of the band of sheet material placed in the first position and a pre-stored thickening position data, generating a thickening presence signal; and further comprising a control unit connected to said first actuator and configured to activate said first actuator in response to said thickening presence signal, to move the first sub-chassis from the printing position to the secure position.

Said control unit is configured to receive the thickening presence signal from the thickener device, the thickening detector and/or the metering device when a thickening exists in the first position of the band of sheet material upstream of the ink jet print heads, and is also configured to activate the first actuator once said thickening presence signal is received producing the movement of the supports away from the ink jet print heads increasing the distance therebetween.

The thickener device described above can be for example an automatic splicer configured to adhere one final end of one partial band of sheet material to one initial end of another successive partial band of sheet material to create the continuous band of sheet material, creating a thickened splice, but other alternatives, such an automatic tag adhesion device, are also proposed.

The thickening detector can be one selected among:

- an optical detector directed towards the band of sheet material;
- a thickness meter for metering the thickness of the band of sheet material;
- a roughness detector in contact with at least one face of the band of sheet material.

Optionally, the digital printing machine may further include an image detector facing a freshly printed surface of the band of sheet material downstream from the printing segments configured to capture images thereof and configured to send said captured images to the control unit. Said control unit will be configured to perform an automatic analysis of the captured images to detect rubbing printing defects and/or ink jet obturation printing defects thereon, and will be also configured to activate said first actuator in response to the detection of rubbing printing defects to move the first sub-chassis away from the ink jet print heads, or to activate the second actuator in response to the detection of an ink jet obturation printing defect, to move the ink-jet print heads away from the printing segments.

In addition, it is proposed to stored data with information of which ink-color is printed by the ink jet print heads of each printing unit on the control unit.

The control unit will be configured to determine which color of the captured image includes the rubbing printing defects and/or ink-jet obturation printing defects and, considering the stored data and the color in which defects are deemed to be present, to determine in which printing unit the rubbing printing defects and/or ink-jet obturation printing defect has been produced, and said control unit will be further configured to activate said first actuator and/or the second actuator to move the first sub-chassis away from the ink-jet print heads, and/or to move printing units from a position opposed to a printing segment to the maintenance position in response to the detection of rubbing printing defects and/or ink-jet obturation printing defects.

According to a particular embodiment of the present system, said one or more supports are:

one rotary roller with a cylindrical surface defining the band path on said cylindrical surface, including multiple successive printing segments therein; or multiple parallel rotary rollers defining a polygonal arched band path including multiple successive printing segments therein, each printing segment being defined coincident with a single rotary roller or being defined between two successive rotary rollers;

multiple parallel rotary rollers and flat plates placed in between said supports defining a polygonal arched band path including multiple successive printing segments therein, each printing segment being defined coincident with a single rotary roller or being defined on said flat plates.

So, according to a first embodiment, the system includes a single support in the shape of a single rotary roller, which can be surrounded by multiple printing units preferably placed on the upper half of the rotary roller, each including multiple ink-jet print heads. The band of sheet material is supported on the band path defined on a portion of the cylindrical surface of said single rotary roller, and multiple successive printing segments can be defined on said band path defined on the cylindrical surface, each printing segment facing one printing unit. Said single rotary roller will be supported on the first sub-chassis and can be moved in a direction perpendicular to the rotation axis of said rotary roller to separate all the printing segments from the respective printing units which are placed on one half of the rotary roller.

According to a second embodiment the support are multiple parallel rotary rollers, the band of sheet material being supported in a taut manner on all that rotary rollers defining a polygonal arched band path. Multiple printing units, each including multiple ink-jet print heads, are facing printing segments defined on said polygonal arched band path. Each printing segment can be defined on the flat portions of the band path defined between adjacent rotary rollers, or alternatively can be defined on the portion of the band path coincident with the cylindrical surface of a rotary roller.

The third embodiment described above is similar to the second embodiment but including also supports in the shape of flat plates between the rotary rollers, the band of sheet material being supported on the rotary rollers and on the flat plates, defining the band path. In this case the printing segments can be defined also on said flat plates.

Preferably said ink-jet printing heads are grouped in printing units, each printing unit including one bridge provided with:

linear guides, having a length greater than the width of the band path and which extends in a transverse direction tangent to the respective printing segment and perpendicular to the direction of conveyance, and with a carriage slidable arranged on said guides, said carriage containing at least the ink jet print heads of said printing unit and being connected to a second actuator configured to move the carriage along the guides;

so that the ink-jet printing heads are movable from a position opposed to a printing segment to a maintenance position in which the ink-jet print heads are arranged in a position non-opposed to the band path, on one side of the printing segment.

So, according to that, each printing unit can include at least one bridge provided with guides and a sliding carriage containing at least the ink-jet print heads of said printing unit. Said guides will preferably have a length greater than the width of the band path, said width of the band being measured in a transverse direction perpendicular to side edges of the band, one part of said guide overlapping the band and another part of said guide projecting beyond the vertical projection of the band path, such that the sliding carriage connected to said guides is movable:

from the position overlapping the band to a maintenance position, in which the ink-jet print heads are arranged in a position non-opposed to the band path, on one side of the printing segment.

It will be understood that a reverse construction in which the guides are fixed to the carriage and will slide with respect to the bridge would be completely equivalent to the described solution, and that said reverse solution will therefore also be covered by the protection offered by this document.

Furthermore, it is proposed for each bridge to be attached to the second sub-chassis at a first anchoring point by an adjustment device and at a second anchoring point by an articulation or by another adjustment device, the first anchoring point and the second anchoring point being spaced apart, and wherein each adjustment device can be independently controlled and includes a mechanism determining a movement of the corresponding first or second anchoring point of the bridge with respect to the second sub-chassis.

This feature allows each bridge to be able to correct its position, and therefore the position of the corresponding printing unit, with respect to the corresponding printing segment of the band of sheet material and with respect to the other bridges integrated in other printing units, which allows modifying the distance and inclination of each ink-jet print head with respect to other ink-jet print heads and with respect to the corresponding printing segment.

Said adjustment device can be, according to an example, a screw or spindle parallel to the conveyance direction in the correspondent printing segment, permitting a precise displacement of one or both ends of each bridge in said direction parallel to the conveyance direction to assure that said bridge is perfectly perpendicular to the conveyance direction and that all the bridges are perfectly parallel to each other.

These features allow the proposed digital printing module to allow moving the printing units for maintenance, while at the same time allows adjusting, in a precise manner, the exact position of each digital ink jet print head to achieve optimum printing.

Therefore, it is proposed for the print heads of each printing unit to be supported on a sliding carriage which can slide along guides forming part of at least one bridge.

The guides can be parallel to the transverse direction, forming an angle of 0° with the corresponding printing segment of the sheet material, such that the movement of the sliding carriage also occurs in a direction parallel to the transverse direction, transverse to the band path in the corresponding printing segment.

Optionally, the guides can be inclined at any angle comprised between 0° and 45° with respect to the corresponding printing segment of the sheet material, such that the movement of the sliding carriage occurs following said inclination, causing the carriage to move not only transversely with respect to the printing segment, but also to move further away or closer in the perpendicular direction with respect to said printing segment. This allows the distance existing between the ink-jet print heads and the sheet material to be increased when the carriage is moved from the printing position to the maintenance position, thereby assuring that accidental contact between both elements, which may soil the sheet material and damage the ink jet print heads, does not occur.

Preferably, said guides will have a length at least of twice the width of the band of sheet material, such that they allow the sliding carriages to slide along the entire length thereof, with the ink-jet print heads being located either completely opposite the printing segment of the band of sheet material in the printing position, or completely outside the band of sheet material, on one side thereof, in a maintenance position, therefore allowing easy access to each of the ink-jet print heads of each digital printing unit.

By providing each digital printing unit with its own sliding carriage, one or more digital printing units can be placed in the maintenance position while the remaining printing units are kept in the printing position and can therefore continue printing, performing both tasks simultaneously.

Furthermore, the fact that each digital printing unit includes at least one bridge of its own, which is independent of the bridges of the remaining printing units, allows adjusting the precise position of each bridge in an individual manner.

To achieve the foregoing, each bridge is attached to the chassis in two positions that are spaced apart, at a first anchoring point by an adjustment device and at a second anchoring point by an articulation or by another adjustment device, the first anchoring point and the second anchoring point being spaced apart, and wherein each adjustment device includes a mechanism determining a movement of the first or second anchoring point of the bridge with respect to the chassis.

Each position adjustment device allows modifying, in a precise and controlled manner, the position of one of the anchoring points spaced apart from those that are attached to the bridge.

This feature allows correcting small deviations or misalignments that may exist between the different digital printing units, causing imperfections in the print, where these deviations may be caused, for example, by expansions, blows, tolerances between parts, or a different location of one or more components following their maintenance.

According to a preferred embodiment, the first anchoring point and the second anchoring point are located one on each side of the band path, on opposite sides of each printing segment, the printing segments being arranged opposite a portion of the bridge comprised between said first and second anchoring points.

Preferably, the first and second anchoring points are located adjacent to the ends of the rollers, with at least one of them being located in an intermediate position of the bridge, a part of the bridge projecting in cantilever fashion beyond one of said first and second anchoring points, defining a maintenance passageway below the cantilever segment of the bridge.

Obviously, it is also contemplated that the first and second anchoring points can be located at the ends of the bridge, the rollers, the band, and the maintenance passageway being comprised below the bridge between the first and second anchoring points.

According to another embodiment of the invention, it is proposed for each adjustment device to include an adjustment mechanism determining the movement of the first anchoring point or the first and second anchoring points of the bridge in the perpendicular direction of the respective printing segment. This will allow modifying at least the inclination of the ink-jet print head with respect to the corresponding printing segment, which allows assuring that both elements are perfectly parallel, correcting their inclination if there is any deviation.

In addition, not included in the present claims but allowable for a divisional application, it is proposed to include a first measuring device configured for measuring the separation existing between an ink jet print head and the band of sheet material of the respective printing segment at different points along said ink jet print head.

Said measuring device may be a manual measuring device operated by an operator to measure the separation existing between the ink-jet print head and the printing segment at different points of the length thereof, thereby allowing the operator to detect deviations of the inclination, and therefore proceed to correct same by actuating the adjustment device or devices. An example of this embodiment would be the use of gauges to detect separation at opposite ends of one and the same ink jet print head, checking that they are identical or if there is a deviation.

Obviously, other embodiments are also contemplated, such as embodiments in which, for example, the measuring devices are integrated next to the rollers, or in the bridge, in the carriage, or in the ink jet print heads, where said measuring devices can be analog measuring devices, such as rulers or stops, for example, or digital measuring devices, such as distance sensors, for example, such as laser sensors, for example.

It is also proposed that each adjustment device may include an adjustment mechanism determining the movement of the first anchoring point or the first and second anchoring points of the bridge in the longitudinal direction. This will allow modifying the inclination of each ink jet print head with respect to the direction of conveyance, which allows assuring that the ink jet print heads are perfectly perpendicular to said direction of conveyance or correcting their inclination if a deviation is detected, thereby getting all the ink-jet print heads to be arranged perfectly parallel to one another.

Each adjustment device may also include an adjustment mechanism determining the movement of the first anchoring point or the first and second anchoring points of the bridge in the transverse direction, thereby centering each ink-jet print head in the respective printing segment, assuring that all the ink jet print heads are perfectly aligned.

According to a preferred embodiment, the module includes a second measuring device located downstream of the ink-jet print heads and configured for capturing images of the printed band of sheet material at different points of the width of the band of sheet material, so as to automatically analyze said images identifying images printed with each individual ink jet print head, and detect and measure misalignments between said images printed with different ink-jet print heads.

The second measuring device will preferably include a camera oriented towards the band of sheet material for capturing images printed thereon. Said images will be transmitted to a control device configured for analyzing said images and detecting any existing deviation of the different ink-jet print heads.

This can be achieved, for example, by printing print marks that can be readily recognized in an automatic manner by the control device, or programming said control device so that it compares the images captured by the cameras with the digital file based on which the ink-jet print heads have performed the printing. This will allow detecting any discrepancy between the desired image and the actual image obtained by the printing process, detecting deviations.

For example, each color both of the image obtained with the second measuring device and of the stored image to be printed can be analyzed separately, measuring the separations existing between different reference points, motifs, or motif edges of the different colors, etc. The comparison between the results of both analyses will allow the control device to determine if a color is not printed in a correct position with respect to the rest of the colors, and also to determine the distance of said deviation, which therefore allows calculating the position adjustment that must be applied by the position adjustment devices.

Alternatively, it is proposed for the second measuring device to be configured for measuring the separation existing between one ink-jet print head and another ink-jet print head at different points along each ink jet print head, which allows detecting any deviation between the different ink jet print heads. Said measurements must have a high precision in order to assure correct alignment of all the ink jet print heads; this can be achieved, for example, by laser meters which measure distances between reference points of each ink-jet print head and said laser meter.

It is proposed that each adjustment mechanism may include one spindle for actuating each direction of adjustment existing in each adjustment device, i.e., one spindle for the perpendicular direction, one spindle for the transverse direction, and one spindle for the longitudinal direction. The spindle will allow precisely adjusting the position of the corresponding bridge by the rotation thereof and will prevent the position from being accidentally changed without the actuation of the mentioned spindle.

When an adjustment device has several degrees of freedom, the different spindles integrated therein will preferably be orthogonal to one another.

Each adjustment mechanism can be operated manually by an operator, for example, based on the deviations detected by the first measuring device or based on information provided by a control device connected to the first and/or second measuring devices, for example through a display or another information transmission interface, allowing an operator to read said control orders and perform manual adjustment of each adjustment device, which can therefore be mechanical adjustment devices lacking servomotors or other automatically-actuated devices.

Alternatively, it is also proposed that each adjustment mechanism may be operated automatically by a servomotor or stepper motor controlled by a control device connected to the first measuring device and/or to the second measuring device and configured for generating control orders to correct the position of the bridges in response to the data obtained by said first and/or second measuring device. The precise actuation of the servomotor or the stepper motor will cause a precise adjustment of the position of each bridge, and therefore of each associated ink jet print head, correcting possible deviations.

Each adjustment device may furthermore include a servomotor for actuating each direction of adjustment, so there will be as many servomotors as adjustment directions in each adjustment device, said servomotors being connected to the rest of the adjustment device and/or to the corresponding spindle such that the actuation of a servomotor causes modification of the relative position of the bridge with respect to the chassis in one of the established longitudinal, transverse, or perpendicular directions.

The servomotors will be controlled through a control device, for example, a programmable logic controller.

In the scope of this patent, it will be understood that a servomotor and a stepper motor are equivalent.

According to another embodiment of the invention, each sliding carriage may contain a first centering element complementary to a second centering element attached to the corresponding bridge, the first and second centering elements being arranged opposite and aligned with one another in the sliding direction of said sliding carriage, and configured for being tightly coupled when the sliding carriage is at the end of travel in the printing position.

Therefore, when the sliding carriage moves to the printing position, the first centering element attached to the sliding carriage will be tightly coupled to the second centering element attached to the bridge, thereby precisely positioning the sliding carriage in said printing position, reducing imprecisions or deviations.

The first centering element may consist, for example, of at least one element with a semi-spherical, conical, frustoconical, pyramidal, or convex frustopyramidal geometry, i.e., a protruding geometry, whereas the second centering element will consist of at least one element with a geometry having the same shape and size as the first centering element but concave, allowing the insertion of the first centering element inside the second centering element, achieving a tight coupling.

Alternatively, a configuration identical to the one described above is considered, but in which the first centering element is concave and the second centering element is convex, the second centering element therefore being inserted into the first centering element.

In relation to the maintenance positions of the printing units, it is proposed for said maintenance positions to be:

- overlapping a user-accessible maintenance passageway, said ink jet print heads being accessible from said maintenance passageway; and/or
- overlapping and associated with at least one ink-jet print head cleaning unit; and/or
- overlapping and associated with at least one hermetic closure cover for the ink-jet print heads to prevent the ink therein from drying up.

It is understood that a user-accessible maintenance passageway will preferably be a passageway with a minimum free height of 1.5 m, preferably being more than 1.7 m.

Therefore, with the digital printing units in the maintenance position, it is proposed for the ink jet print heads not only to be accessible for an operator, but also accessible for an ink jet print head cleaning unit or a cleaning unit for each carriage bearing a print head, or for each color, which may automatically apply a cleaning cycle that eliminates ink residues from the ink jet print heads, or a hermetic closure cover for the ink-jet print heads which will seal said print heads, preventing the ink therein from drying up.

Both the head cleaning unit and the hermetic closure cover may be coupled to the ink jet print heads manually by an operator from the maintenance passageway, or they may be coupled automatically.

For example, a hermetic closure cover and/or a head cleaning unit may be associated with each maintenance position of each ink-jet print head, being movable between an active position in which it interacts with the ink jet print head in the maintenance position, and an active position in which it does not interact with said ink jet print head.

The movement of the hermetic closure cover and/or the head cleaning unit from the active position to the passive position or vice versa may be performed manually or automatically by an actuation device controlled by the control device.

Although both the hermetic closure cover and the head cleaning unit can be constituted according to different embodiments, it is contemplated that said cover and/or each head cleaning unit is attached to the chassis in a swiveling manner, such that the operator or the actuation device only has to swing them in order to move them from the active position to the passive position, or vice versa.

According to another embodiment, all the ink jet print heads share a single head cleaning unit, in such case said head cleaning unit can be attached to the chassis in a sliding or swiveling manner, allowing the placement thereof opposite the maintenance position of any of the print heads both manually and automatically by the actuation device.

In relation to the rollers, it is proposed for:

- the ink jet print heads of all the digital printing units to be arranged opposite one and the same central roller, such that each corresponding printing segment corresponds with a different portion of the band of sheet material supported directly on said central roller; or the ink-jet print heads of each digital printing unit to be arranged opposite different rollers, such that the corresponding printing segment thereof corresponds with a portion of the band of sheet material supported directly on each of said rollers; or each of the ink-jet print heads of each digital printing unit to be arranged opposite a gap existing between two contiguous rollers, such that the corresponding printing segment thereof corresponds with a taut portion of the band of sheet material between two adjacent rollers.

Therefore, according to one embodiment there is a single central roller supporting multiple successive printing segments and surrounded by multiple digital printing units. This solution prevents an elastic sheet material from being sustaining deformations between successive printing steps which may negatively affect the final print obtained.

According to another proposed embodiment, said rollers will be a plurality of rollers parallel to one another, defining as a whole an arcuate band path, the printing units being distributed along said arcuate band path, with one printing segment being arranged on each roller, or with each printing segment being comprised between two successive rollers.

According to another proposed embodiment, the chassis includes a first sub-chassis supporting one or more rollers, and a second sub-chassis supporting one or more printing units, the first sub-chassis and the second sub-chassis being attached in a movable manner, allowing modification of the separation existing between the printing segments defined by the rollers and the corresponding ink jet print heads of the printing units.

In other words, the first and second sub-chassis are movable with respect to one another, modifying the separation existing between the ink-jet print heads and the printing segments, so said movement will occur in a perpendicular direction, or will have a major component in said perpendicular direction.

That will allow adapting the printing module to different thicknesses of sheet material, readily adapting the printing module to thinner or thicker sheet materials, keeping the separation between the printing segment and the corresponding ink-jet print head constant.

Optionally, it is furthermore proposed to include, upstream of the printing units, a thickening detector for detecting thickenings in the band of sheet material, and wherein the relative movement between the first sub-chassis and the second sub-chassis is operated by an first actuator connected to said thickening detector and configured for temporarily increasing the separation between the printing segments and the ink jet print heads in moments after the detection of a thickening by the thickening detector.

It will be understood that a thickening can be for example a splice, which is a segment of the band of sheet material in which the ends of two successive segments of sheet material overlap, so the sheet material in the splices has twice the thickness of segments without a splice. This may lead to the splice coming into contact with the ink jet print heads as it passes through the printing units, due to the scarce separation between said heads and the band of sheet material, damaging or moving them.

Alternatively, the thickening can be, for example, a defect in the band of sheet material, such a wrinkling, which can also be detected by said thickening detector.

This allows the separation to be increased upon the detection of a thickening, allowing the passage of the band of sheet material and of the thickening contained therein, protecting the ink jet print heads from possible damage.

Said thickening detector can be, for example:

an optical detector directed towards the band of sheet material;

a thickness detector for detecting the thickness of the band of sheet material;

a roughness detector in contact with at least one face of the band of sheet material.

Alternatively, it is proposed for the existence of a splice to be determined by an unwinding-splicing device which is located at a first distance upstream of the printing units (10) and configured for:

unwinding the sheet material from successive reels, feeding the printing unit, the unwinding-splicing device automatically splicing the final end of the sheet material of one reel with the front end of the sheet material of the successive reel, producing splices in the continuous band of sheet material; and said unwinding-splicing device generating a signal indicating the existence of a splice when said splice is produced.

In such case, the unit in charge of generating the splices is the thickening detector.

Additionally, it is also proposed that the system may have stored therein the distance existing between the thickening detector and the digital printing units, which thereby allows postponing the relative movement of the first and second sub-chassis until the moment before the splice reaches the printing units, the latter being a moment after the moment in which the splice is detected.

By knowing the speed of conveyance of the band of sheet material and the mentioned distance, the system can calculate the optimal moment to proceed to said opening by the distance, minimizing losses of the band of sheet material.

Information about the speed of conveyance of the band of sheet material will preferably be supplied by the system controlling the actuation of said conveyance, although the use of sensors themselves for directly measuring the mentioned speed is also contemplated.

To achieve this, it is proposed for the head protection system to postpone the interruption of the printing and the positioning of the first and/or second sub-chassis in the open position to a pre-established final fraction of calculated time it will take the splice to reach the printing units, for example, to the last half of that time, to the last quarter of that time, etc.

According to another proposed embodiment, the first sub-chassis is attached in an articulated or sliding manner to said second sub-chassis. A reverse construction in which the second sub-chassis is attached in an articulated or sliding manner to the first sub-chassis is also contemplated.

The probable existence of multiple successive first sub-chassis and/or multiple successive second sub-chassis is furthermore contemplated.

In addition to the preceding features, it is also proposed for the rollers to support a closed conveyor belt, i.e., a continuous conveyor belt, which reproduces in a portion thereof the band path, the band of sheet material being supportable and conveyable on said conveyor belt. This allows the sheet material to be a succession of individual laminar panels, or to be of a weak or elastic material. Since it is supported on a conveyor belt, it is assured that said sheet material will not sustain deformations nor will it break during passage through the digital printing module.

Additionally, is contemplated that said conveyor belt may at least be partially heated, which will speed up the drying time of each of the inks printed with the different ink jet print heads. The conveyor belt can be heated downstream of all the ink jet print heads, with all the inks printed on the sheet material being dried together, or the conveyor belt can be heated after each of the ink jet print heads, with each ink being dried after printing, before the printing of an additional ink.

Alternatively, it has been envisaged that the mentioned conveyor belt has a functionality of drying or curing the printed material with IR lamps, or by providing a hot airflow, or other solutions well known in the sector.

Another embodiment contemplates that a plate flush with the band path is arranged in the gap existing between two contiguous rollers, said plate being heated.

Optionally or alternatively, said plate flush with the band path will be perforated and connected to suction equipment, thereby assuring that the sheet material will be perfectly flat and in contact with said plate.

Other features of the invention will become apparent in the following detailed description of an embodiment.

BRIEF DESCRIPTION OF THE DRAWINGS

The foregoing and other advantages and features will be better understood based on the following detailed description of an embodiment in reference to the attached drawings which must be interpreted in an illustrative and non-limiting manner, in which:

FIGS. 4*a* and 4*b* show schematic perspective views of a portion of the system including two parallel rollers, a portion of the band path including a printing section supported on said rollers, and a schematic drawing of a printing unit showing a guide extending in the transverse direction, a carriage including ink-jet printing heads, wherein FIG. 4*a* shows the ink-jet printing heads being placed in the printing position and FIG. 4*b* shows the ink-jet printing heads being placed in the maintenance position;

Figure 1A:
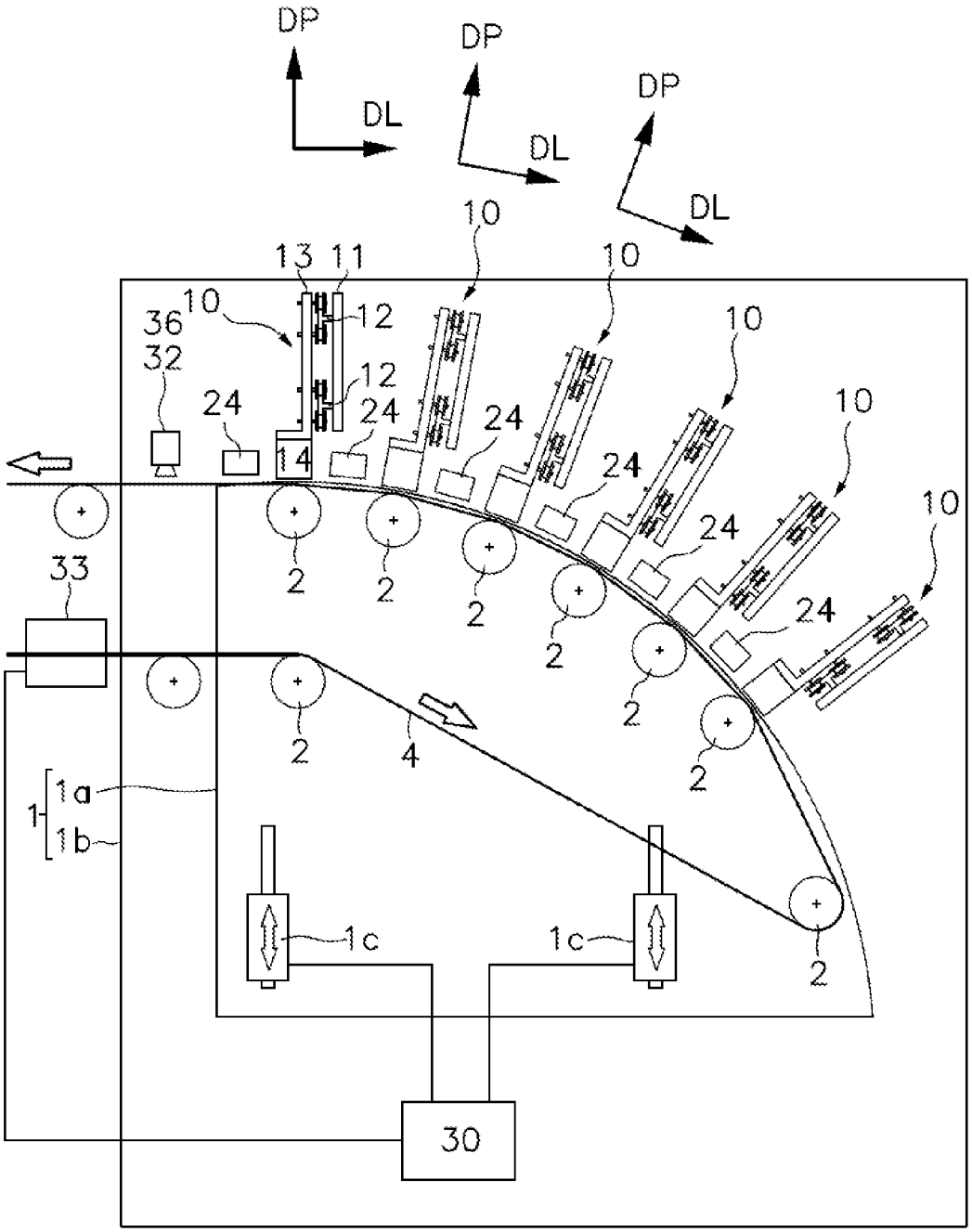
FIGS. 1*a* and 1*b* shows a longitudinal section of the system according to an embodiment in which the supports are six rollers arranged in succession, defining an arcuate path for the band of sheet material, and provided with six printing units, each provided with digital ink-jet print heads arranged opposite a printing segment supported on one of said rollers, and all the rollers being supported on a first sub-chassis attached in a sliding manner to a second sub-chassis supporting the printing units, FIG. 1*a* showing the supports being placed in the printing position, and FIG. 1*b* showing the supports being placed in the secure position.

In the drawings showing several printing segments 6, the transverse, longitudinal, and/or perpendicular directions of at least some of said printing segments 6 have been indicated by a coordinate arrow system; therefore, in some cases various coordinate systems are included in one and the same drawing, one for each printing segment.

An arrow indicates the direction of movement of the sheet material along the path for the band of sheet material defined by the rollers.

DETAILED DESCRIPTION OF AN EMBODIMENT

The attached drawings show illustrative, non-limiting embodiments of the present invention.

The present invention relates to a ink-jet print heads protecting method and system for digital printing machines.

The proposed system comprises multiple rollers 2 parallel to one another provided for supporting and conveying a band of sheet material 4 in a taut manner, defining a path for the band of sheet material 4. Parts of said band path, corresponding with printing segments 6, are arranged opposite digital ink jet print heads 14 which are heads provided for projecting microdroplets of ink in precise positions of a printing segment of the sheet material in correspondence with the movement of the sheet material along the band path, thereby printing images stored in digital format on the sheet material in a quick, clean, and precise manner.

Each digital ink jet print head 14 is integrated in a printing unit 10.

Each printing unit 10 has its corresponding digital ink jet print heads 14 located opposite, adjacent, and orthogonal to a printing segment 6 of the sheet material 4. Each printing segment defines, in coincidence with the plane defined by the sheet material 4, a transverse direction DT which will be tangent to the band of sheet material in the printing segment 6 and perpendicular to the direction of conveyance of said band of sheet material in that printing segment 6, and a longitudinal direction DL which will be parallel to the direction of conveyance of the sheet material in that printing segment 6 and tangent to the band also in that printing segment 6. A perpendicular direction DP will be that direction perpendicular to the transverse direction DT and longitudinal direction DL, and therefore also perpendicular to the sheet material 4 in the printing segment 6.

In the embodiment shown in the Figures a few of said rollers 2 are arranged in an arcuate configuration, therefore also defining an arcuate path for the band of sheet material at least in the segment supported on said rollers 2, where the printing segments 6 are located.

As shown in FIGS. 1*a*, 1*b* and 2*a*, 2*b* the rollers 2 defining the arcuate portion are supported on a first sub-chassis 1*a* which is attached to a second sub-chassis 1*b* in a movable manner, allowing relative movement between both, said first and second sub-chassis 1*a* and 1*b* being constituents of the chassis 1.

In the embodiment shown in FIG. 1, both first and second sub-chassis 1*a* and 1*b* are attached by guide elements, in this example vertical guides, which allow moving the first sub-chassis 1*a* and the rollers 2 it supports in a direction away from the digital ink-jet print heads 14, which therefore allows modifying the distance between these elements to adapt to different thicknesses of the band of sheet material.

In the embodiment shown in FIG. 2, both first and second sub-chassis 1*a* and 1*b* are attached by an articulated attachment allowing the first sub-chassis 1*a* to swivel with respect to the second sub-chassis 1*b*.

A first actuator 1*c* provided for actuating the movement of the first sub-chassis 1*a* with respect to the second sub-chassis 1*b* has been included in the two embodiments.

The activation of said first actuator 1*c* is activated by a control unit 30 as a response to a thickening presence signal produced by a thickener device 33. a thickening detector 34 or a metering device 35 located upstream of the printing units 10.

Figure 1B:
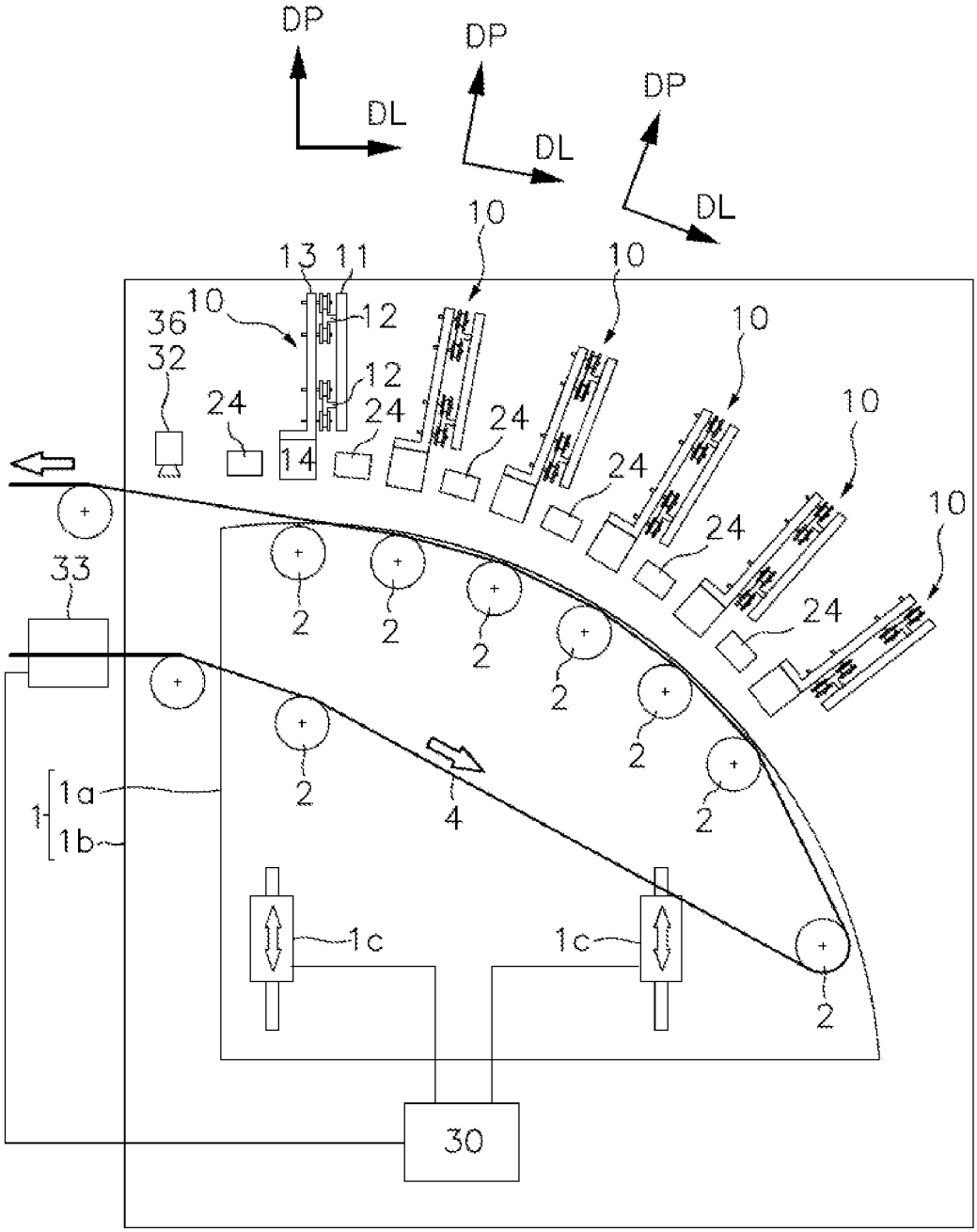

FIGS. 1*a* and 1*b* shown a first embodiment provided with a thickener device 33, for example a splicer configured to adhere one final end of a partial band of sheet material with one initial end of another partial band of sheet material to generate a continuous band of sheet material, but creating a thickening in the splice. Said thickener device 33 communicate a thickening presence signal when a splice is created to the control unit 30 and said control unit 30 activate the first actuator 1*c* previous to the arrival of the thickening to the printing segments 6.

Figure 2A:
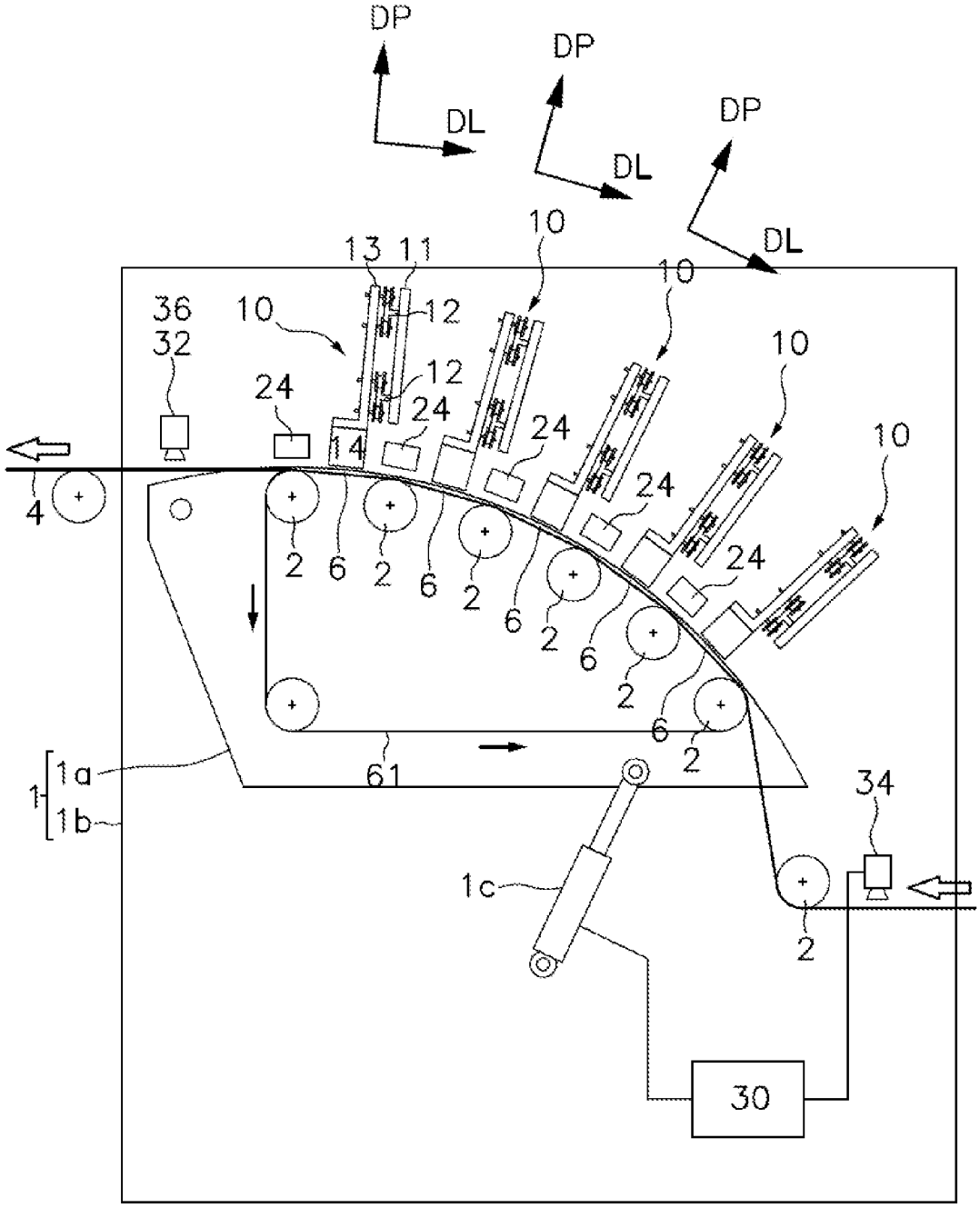
FIGS. 2*a* and 2*b* shows a digital printing module similar to the one shown in FIG. 1*a* but provided with 5 printing units, each provided with a digital ink-jet print head arranged opposite a printing segment located in a portion of sheet material located in the interspace existing between two adjacent rollers, the digital printing module being additionally provided with a conveyor belt, and all the rollers being supported on a first sub-chassis attached in a swiveling manner to a second sub-chassis supporting the printing units, FIG. 2*a* showing the supports being placed in the printing position, and FIG. 2*b* showing the supports being placed in the secure position.
Figure 2B:
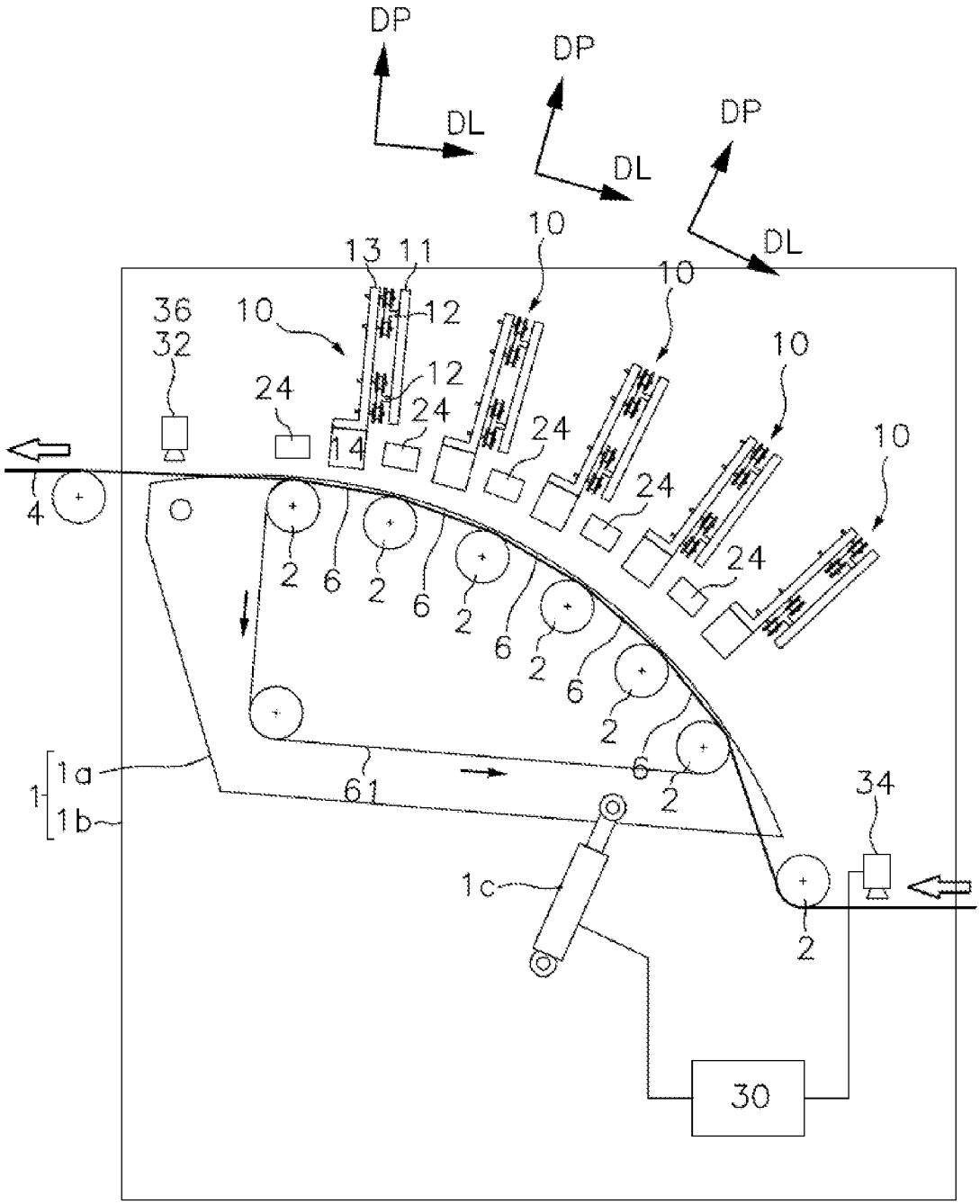

FIGS. 2*a* and 2*b* shown a second embodiment provided with a thickening detector 34 represented in these examples as a camera oriented towards the band of sheet material 4 for detecting the approach towards the printing units 10 of a thickening, for example a splice or a defect of the band of sheet material, which may damage the ink-jet print heads 14. In such case, a control unit 30 receiving a thickening presence signal from the thickening detector 34 actuate the first actuators 1*c* to move the first sub-chassis 1*a* in a direction away from the ink-jet print heads 14, thereby making the space between the printing segments 6 and said ink jet print heads 14 larger, allowing the passage of the detected thickening without causing any damage. The first actuators 1*c* will then return the sub-chassis 1*a* and 1*b* to their initial position to resume printing.

In the embodiment shown in FIGS. 1*a* and 1*b*, the printing segments 6 coincide and are supported on the rollers 2, whereas in the embodiment shown in FIGS. 2*a* and 2*b*, the printing segments 6 are arranged in the interspaces existing between successive rollers 2.

Figure 8:
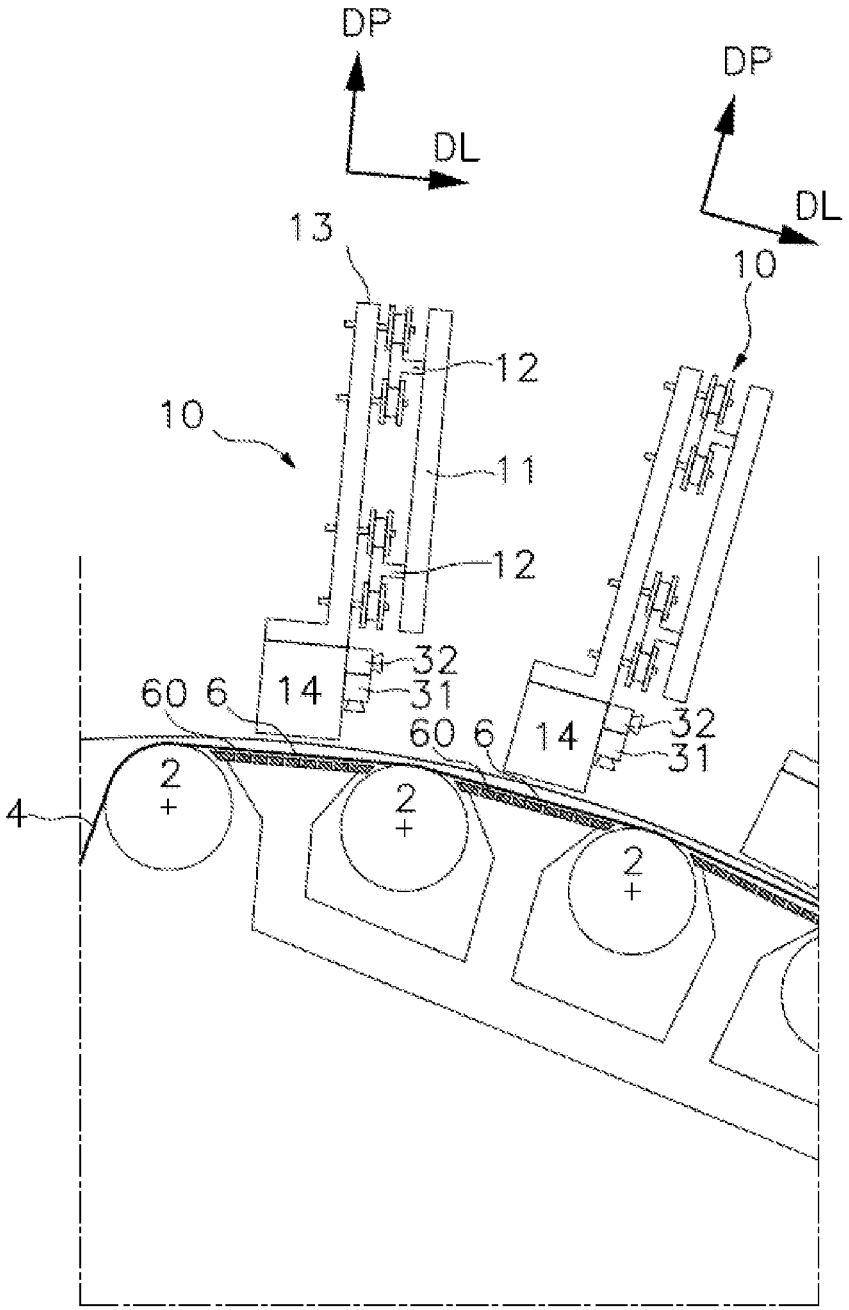
FIG. 8 shows an enlarged detail of an embodiment similar to the one shown in FIG. 2 but lacking a conveyor belt, in which perforated plates connected to suction equipment through air ducts have been included, such that the band of sheet material is suctioned against the plate through said perforations as it passes over said plate, thereby obtaining complete flatness in the printing segment coinciding with said plate. Optionally, said plates can also be heated to increase the ink drying speed.
Figure 9:
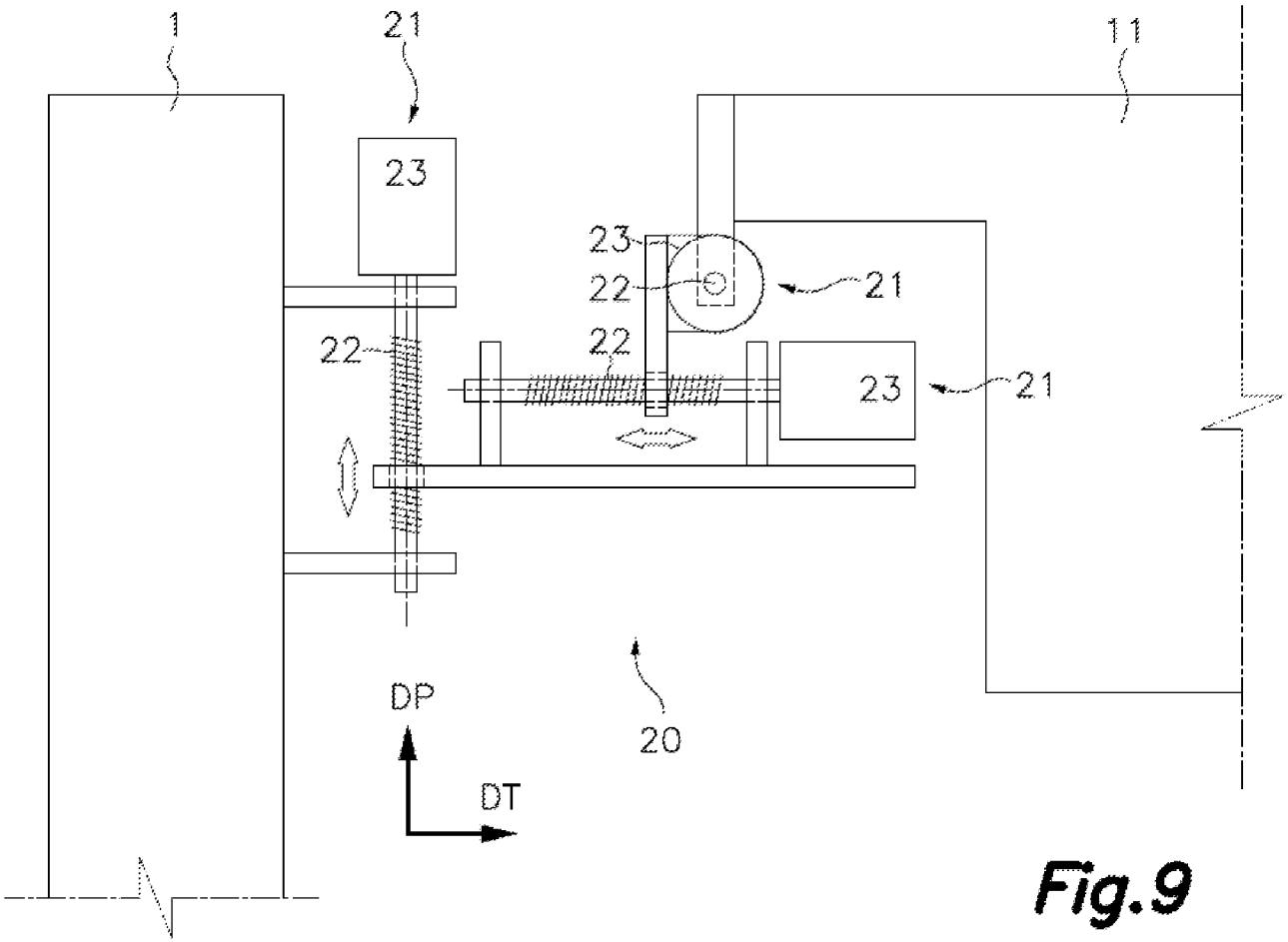
FIG. 9 shows a schematic drawing of a possible embodiment of the adjustment mechanism which allows precise adjustment in the transverse, longitudinal, and perpendicular directions by three mechanisms, each provided with a spindle operated by a motor, the three spindles being orthogonal to one another, each parallel to one of the three transverse, longitudinal, and perpendicular directions.

FIG. 8 shows how there may be arranged, in said interspaces, other supports in the form of flat plates 60 which can be heated to increase the drying speed of the ink printed on the sheet material 4 and can also be perforated and connected by the back thereof to a suction unit through air conduits, thereby getting the band of sheet material to adhere perfectly on the surface of the plate 60 as it passes over same, in this case coinciding with the printing segment 6, thereby getting the printing segment 6 to have a sheet material with a perfectly flat surface.

Alternatively, to said heating of the plates, thermal energy can be provided to said flat plates 60 by an installation with IR lamps, or by providing a hot air flow aimed at the flat plates 60, or other heating solutions well known in the sector.

FIGS. 2*a* and 2*b* furthermore shows how, at least in part of said band path, the sheet material is supported on a continuous conveyor belt 61 having a portion supported on said rollers 2 defining the arcuate path. The conveyor belt 61 may be made of a flexible material such as rubber, for example, and may go through a heating unit that allows increasing its temperature above room temperature, such that the temperature of the sheet material supported thereon also increases, thereby accelerating the drying of the printed ink.

Figure 3A:
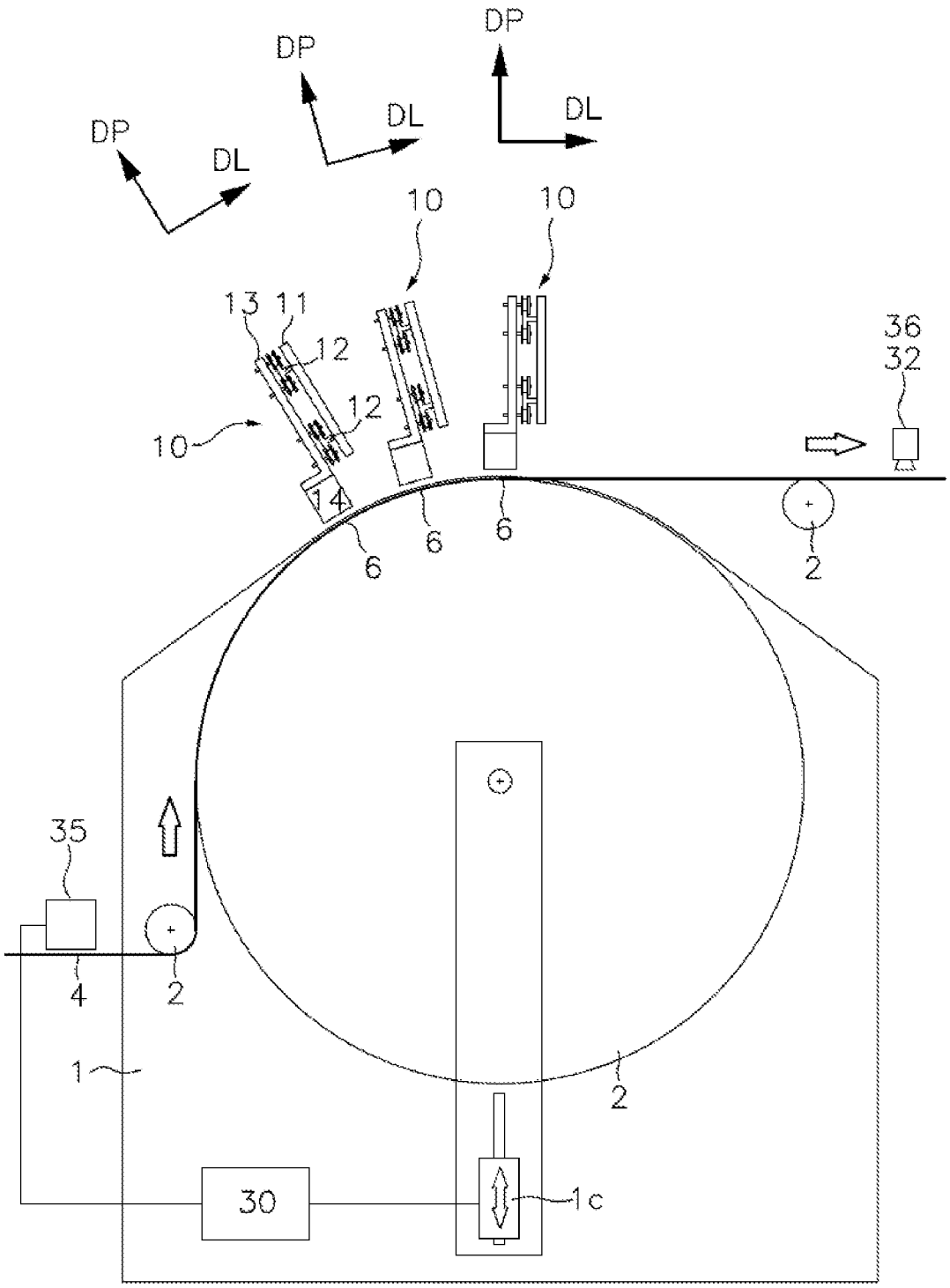
FIGS. 3*a* and 3*b* shows an alternative embodiment of the digital printing module in which one of the rollers is of a diameter that is sufficient so that multiple printing units can have the corresponding digital ink-jet print heads arranged opposite printing segments of the sheet material supported on said roller, FIG. 3*a* showing the roller being placed in the printing position, and FIG. 3*b* showing the roller being placed in the secure position.
Figure 3B:
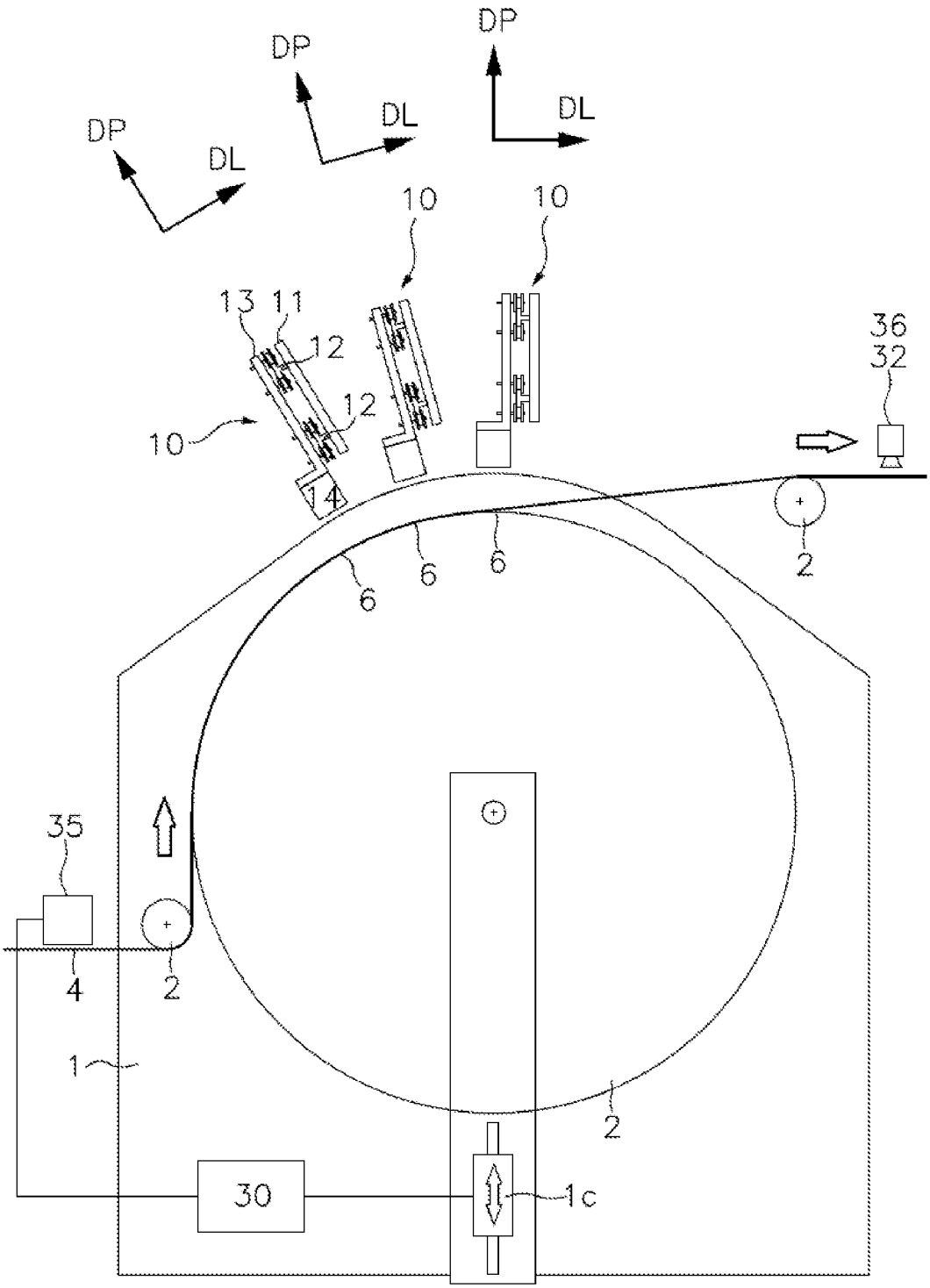
Figure 4A:
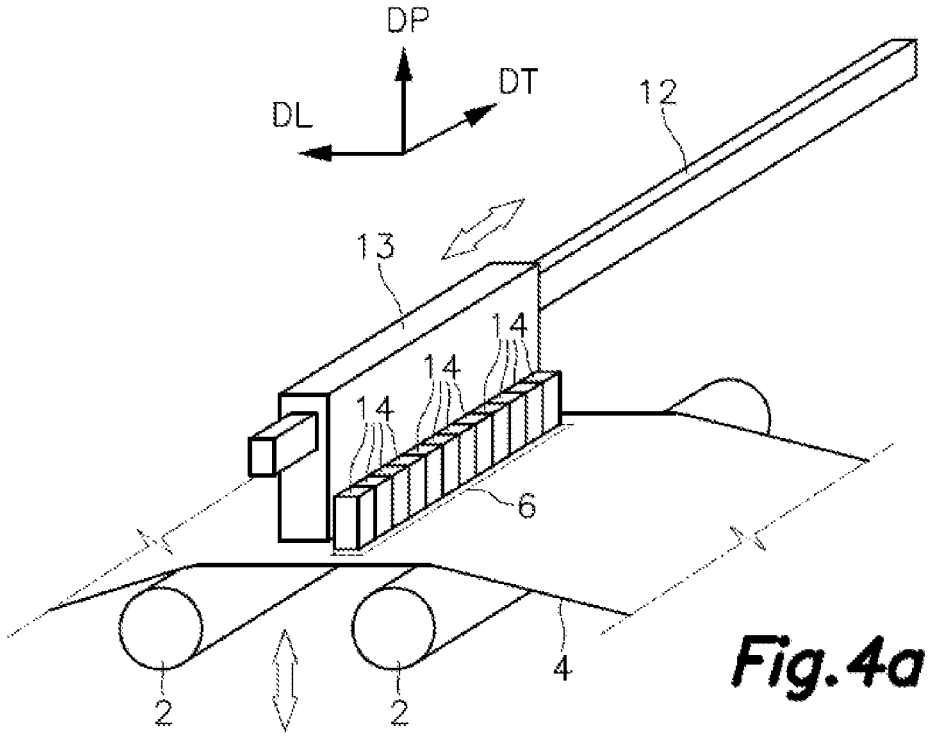
Figure 4B:
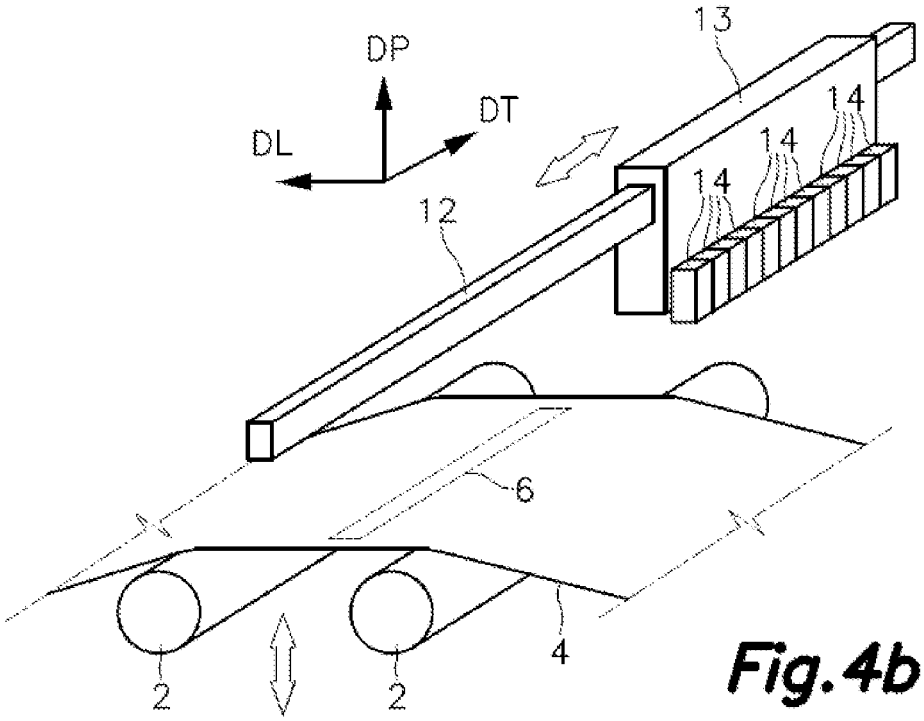

FIGS. 3*a* and 3*b* shows an alternative embodiment in which multiple printing units 10 are all arranged around a single roller 2, the corresponding digital ink-jet print heads 14 being arranged opposite multiple printing segments 6 of the sheet material 4, all supported on the periphery of the mentioned single roller 2, and further including a metering device 35 upstream of the printing segments 6. The metering device 35 determines which specific portion of the band of sheet material 4 is in the first position where the metering device 35 is placed at every moment. Said specific portion of the band of sheet material 4 placed in the first position is compared with a register of portions of the band of sheet material including thickenings, for example splices, wrinkles or other defects, and when the presence of one portion of the band of sheet material, coincident with a portion stored as a thickened portion, is determined to be in the first position a thickening presence signal is generated, triggering the activation of the first actuator 1*c* by the control unit 30. Said register of portions of the band of sheet material including thickenings can be stored in the control unit 30, for example including therein the known defects of a particular laminar material roll unwind to feed the digital printing machine.

Figure 5:
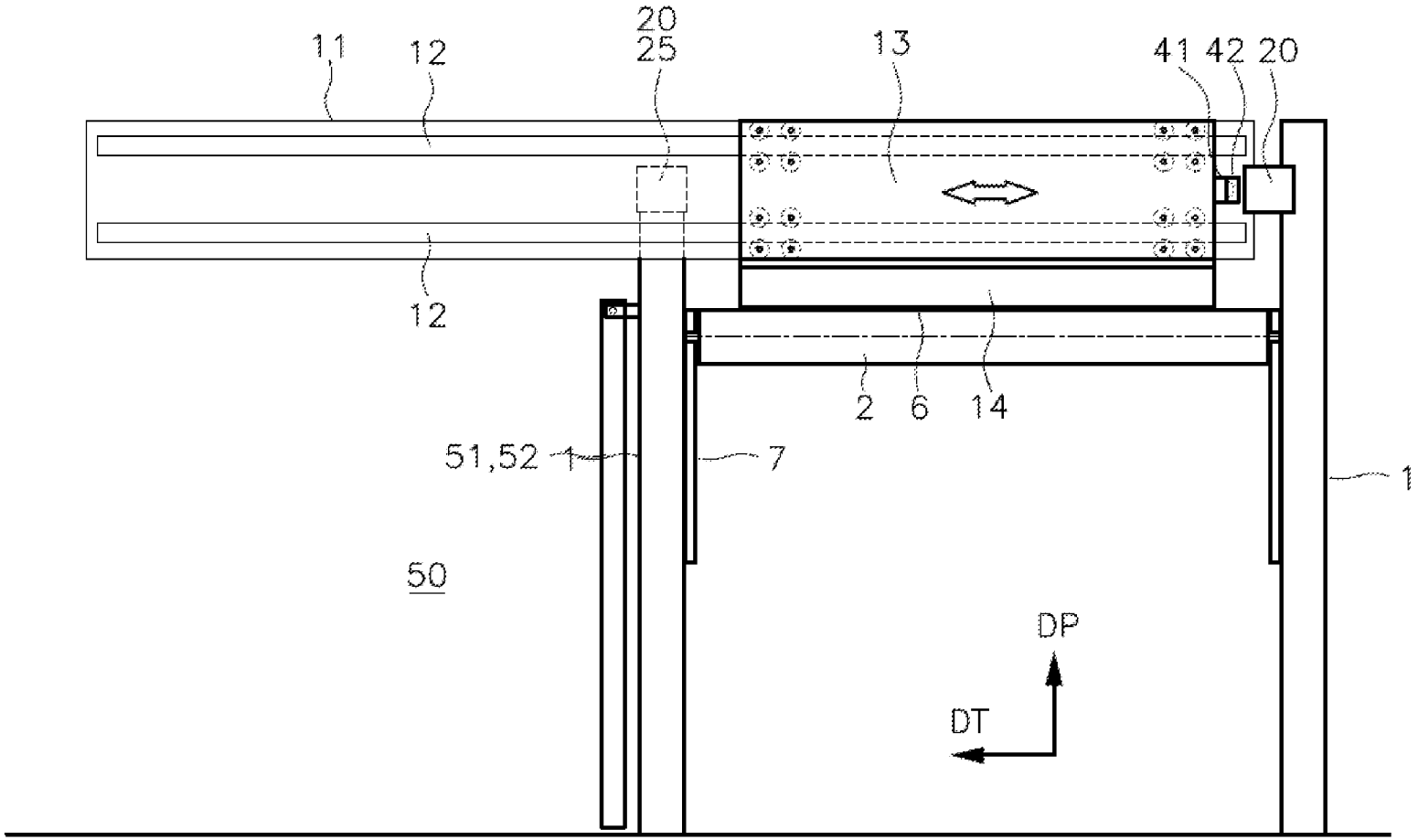
FIG. 5 shows a cross-section of the digital printing module parallel to the rollers, according to the embodiment shown in FIG. 1, the digital ink jet print heads and the corresponding carriage in a printing position being arranged opposite the printing segment, on a roller.
Figure 6:
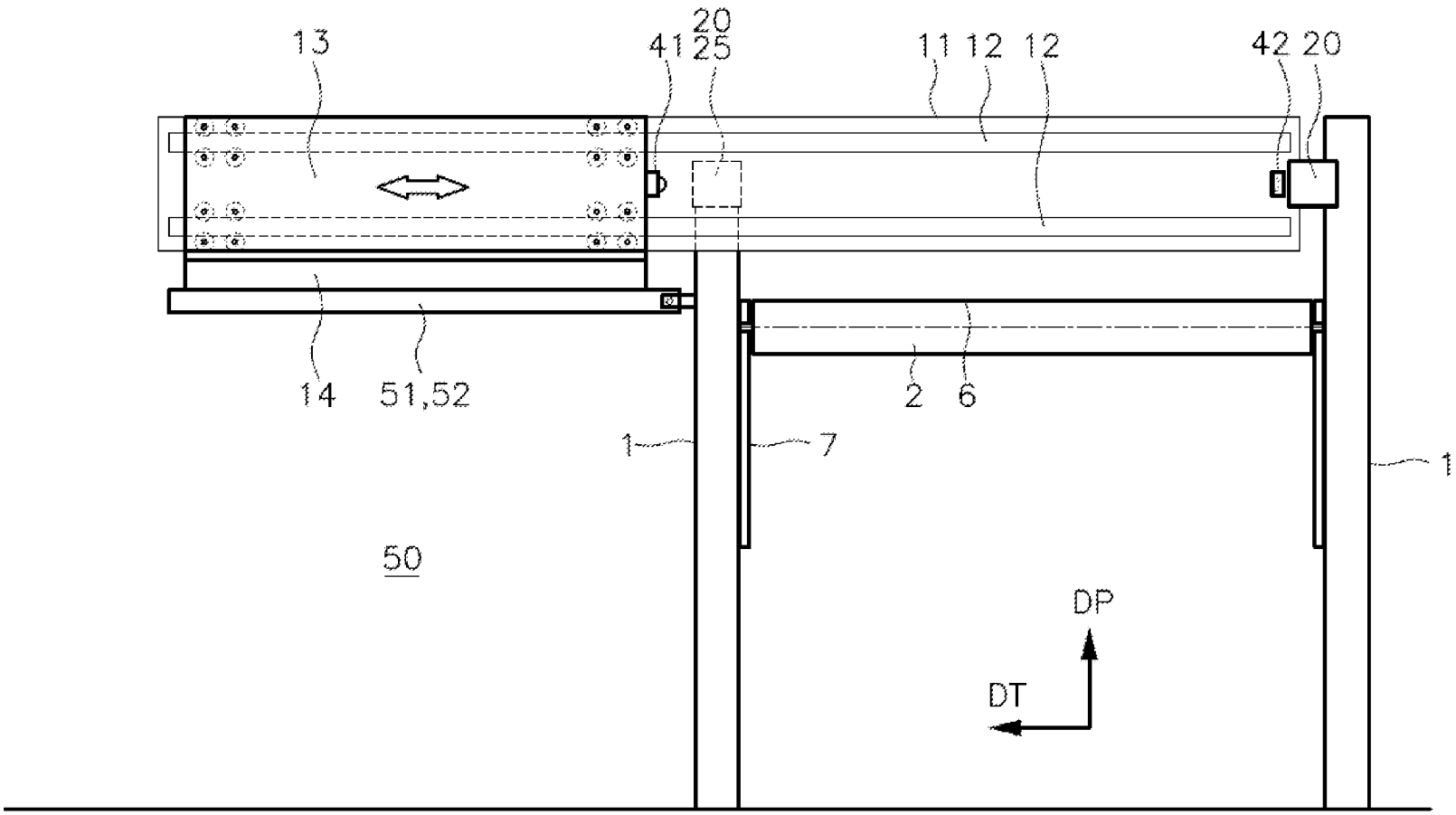
FIG. 6 shows the same view as FIG. 4 but with the digital ink jet print heads and the corresponding carriage in the maintenance position not being arranged opposite the path for the band of sheet material, and with a head cleaning unit or a hermetic closure cover coupled to said digital ink jet print heads for cleaning or protection.
Figure 7:
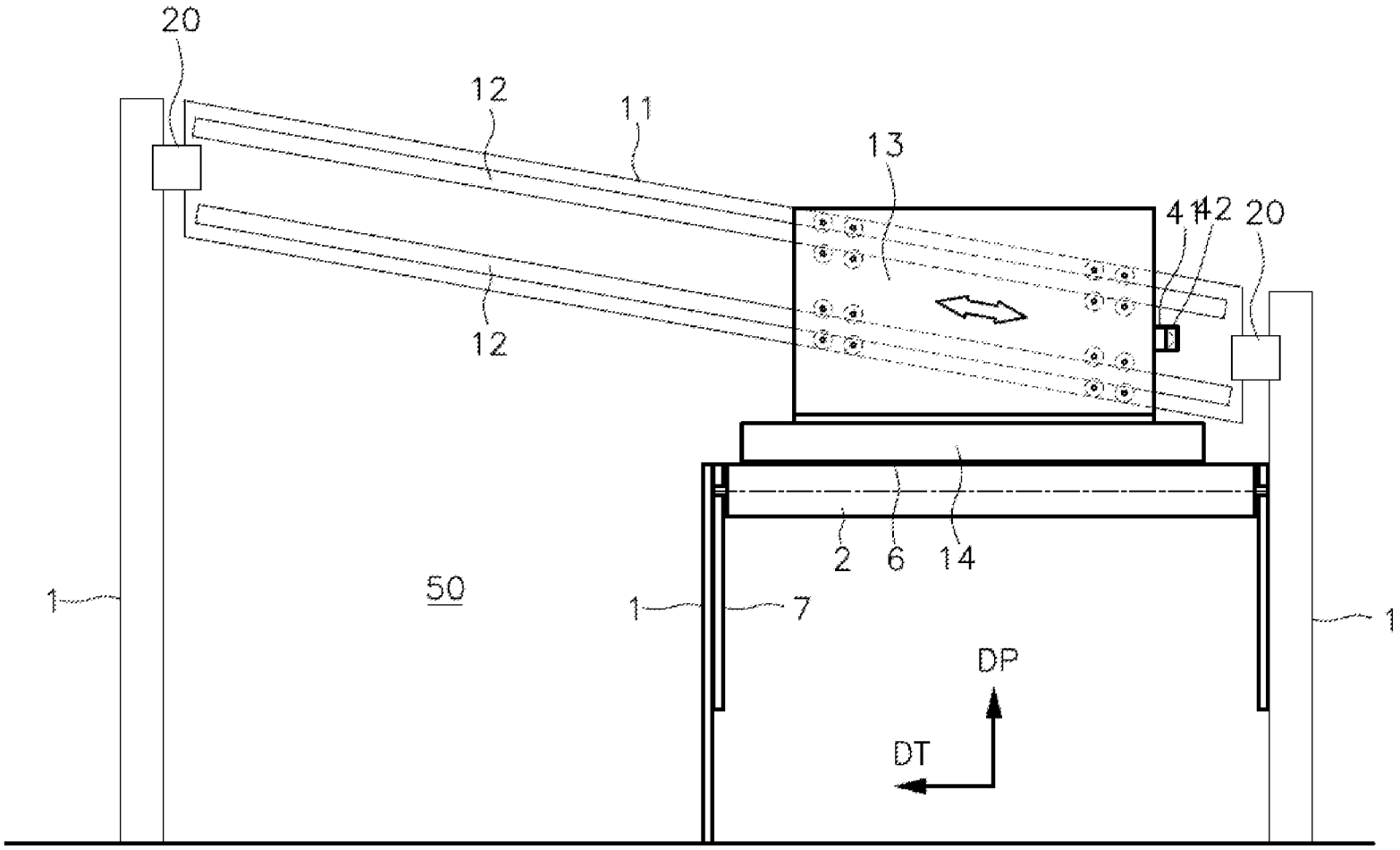
FIG. 7 shows a view equivalent to the one shown in FIG. 4 but according to an embodiment in which the bridge and the corresponding guides are inclined with respect to the printing segment of the band of sheet material.

Both the conveyor belt 61 of FIGS. 2*a* and 2*b* and the single central roller 2 of FIGS. 3*a* and 3*b* allow preventing the band of sheet material from sustaining elongations or deformations during conveyance which may cause distortions in the printed images if it is made of an elastic material, for example.

Where FIGS. 1*a*, 1*b* and 2*a* and 2*b* showed longitudinal section views of different embodiments of the proposed digital printing unit, FIGS. 5, 6, and 7 show a cross-section view of the embodiment shown in FIGS. 1*a* and 1*b* and FIGS. 4*a* and 4*b* shown a partial and simplified perspective view of the embodiment shown in FIGS. 1*a*, 1*b*, 2*a* and 2*b*.

In said cross-sections of the digital printing unit, it can be seen how a printing unit 10 is located above the rollers 2 and above the band path for the band of sheet material, in coincidence with a printing segment 6 which is supported on one of the rollers 2 in this example.

The printing unit 10 consists of a bridge 11 supported on the chassis 1, said bridge 11 being arranged transversely with respect to the band path and having a length of at least twice the width of the band path defined by the length of the rollers 2, half of the bridge 11 being located above the printing segment 6 and the other half projecting laterally form the band path, overlapping a user-accessible maintenance passageway 50.

Specifically, in the example shown in FIGS. 5 and 6, the bridge 11 is arranged parallel to the transverse direction DT with respect to the corresponding printing segment 6.

The bridge 11 includes two guides 12 also parallel to the transverse direction DT.

A carriage 13 is attached in a sliding manner to the guides 12, which allows moving said carriage 13 along the bridge 11 between a printing position shown in FIG. 5, in which the digital ink jet print head 14 of the printing unit 10 is arranged opposite and adjacent to the printing segment 6, and a maintenance position, in which the digital ink-jet print head 14 of the printing unit 10 is not arranged opposite the printing segment 6, being located above the maintenance passageway 50. The size of the carriage 13 will the same as or smaller than the width of the band path defined by the length of the rollers 2.

The sliding attachment between the carriage 13 and the guides 12 will be carried out, for example, by a system of wheels, and will be actuated by an actuation mechanism, provided with motors and belts, not shown in the drawings, for example.

The carriage 13 will include the digital ink-jet print head 14, although it is understood that said digital ink-jet print head 14 may be formed by a plurality of digital ink jet print heads 14 combined so as to cover the entire printing segment 6. Therefore, the movement of the carriage 13 along the guides 12 of the bridge 11 allows moving the digital ink-jet print head 14 of the printing unit 10 from the printing position to the maintenance position or vice versa.

The lateral movement of the ink jet print heads 14 in the transverse direction DT prevents any damage to them when a major thickening exists in the band of sheet material, for example when said band of sheet material breaks and wrinkles.

In the example shown in FIG. 7, the bridge 11 and the guides 12 are not arranged parallel to the transverse direction DT of the printing segment 6 but rather form an upward angle, in this case of 10°, with respect to said transverse direction, such that the movement of the carriage 13 from the printing position to the maintenance position causes the digital ink-jet print head 14 to raise up with respect to the plane defined by the printing segment 6, given that the segment of the bridge located on the maintenance passageway 50 is located at a height greater than the segment of the bridge 11 located on the rollers 2.

Likewise, to assure that the carriage 13 is correctly positioned with respect to the bridge 11 when it reaches the printing position, it is proposed to include a first centering element 41 attached to the carriage 13, and a second centering element 42 attached to the bridge, both centering elements being aligned in the direction of movement of the carriage 13, and positioned for being perfectly coupled with one another when the carriage 13 reaches the printing position. By way of example, it is proposed for said first centering element 41 to include a protruding semi-spherical protruding convex shape complementary to a semi-spherical concave shape having complementary dimensions provided in the second centering element 42. Other geometric shapes such as cone shapes, frustoconical shapes, pyramidal shapes, frustopyramidal shapes, etc., for example, are also contemplated. This allows improving the precision of the positioning of the carriage 13 and the digital ink-jet print head 14 in the printing position.

Despite the foregoing, the positioning of the digital ink-jet print head 14 may be incorrect due to tolerances, expansions, etc.

If all the digital ink jet print heads 14 of all the printing units 10 integrated in the digital printing module are not correctly aligned, the print may include imperfections, so an improvement which allows an independent correct alignment of each printing unit 10 is proposed.

To achieve the foregoing, it is proposed to attach a first anchoring point of each bridge 11 to the chassis 1 through an adjustment device 20, and to attach a second anchoring point of each bridge 11 to the chassis 1 through another adjustment device 20 or through an articulation 25, the first anchoring point and the second anchoring point being spaced apart.

The embodiment shown in FIGS. 5 and 6 shows how the first anchoring point is located at one end of the bridge 11, on one side of the path for the band of sheet material, whereas the second anchoring point is located in an intermediate portion of the bridge 11, on the other side of the band path, the rollers 2 being arranged below the bridge segment 11 comprised between the first and second anchoring points. According to this embodiment, part of the bridge 11 extends in cantilever fashion beyond the second anchoring point, projecting in cantilever fashion through the side of the band path over a maintenance passageway 50.

In the example of FIGS. 5 and 6, the second anchoring point includes the reference numbers referring both to the adjustment device 20 and to the articulation 25, thereby showing that either of the two elements could be located at this point.

In contrast, FIG. 7 shows an embodiment in which the first anchoring point and second anchoring point are located at the two opposite ends of the bridge 11.

Each adjustment device 20 allows precisely moving the anchoring point to which it is connected. When the bridge 11 only has one adjustment device 20, it allows correcting the inclination of the bridge 11 from one of the anchoring points, pivoting the entire bridge 11 with respect to the other anchoring point for correctly aligning same with respect to the corresponding printing segment 6 and with respect to the other bridges 11.

When both anchoring points have adjustment devices 20, in addition to the inclination thereof, the separation of the entire bridge 11 with respect to other bridges 11 or with respect to the corresponding printing segment 6 can be modified. The combination of the precise movement of both ends of the bridge allows modifying the position of the digital ink jet print head 14 held by said bridge 10 to obtain its ideal position.

To achieve said movement of the bridge 11, each adjustment device 20 will provide one, two, or three degrees of freedom, for example, providing movement of the end of the bridge 11 in one or more of the transverse direction DT, longitudinal direction DL, or perpendicular direction DP in relation to the respective printing segment 6.

When the bridge 11 is provided with an adjustment device 20 and an articulation 25, said articulation must have several degrees of freedom compatible with the degrees of freedom of the adjustment device, i.e., if the adjustment device has only one degree of freedom, the articulation 25 must also have at least one degree of freedom in the same direction as that of the adjustment device 20. Therefore, the articulation can be a simple rotary attachment rotating about an axis, allowing rotation in the perpendicular direction DP or in the longitudinal direction DL, for example, or a ball joint, allowing simultaneous rotation in both perpendicular direction DP and longitudinal direction DL, or an articulated attachment which allows sliding in the transverse direction DT.

According to a preferred embodiment one point of the bridge 11 includes an articulation 25 and the other point of the bridge includes an adjustment device 20 comprising a screw or spindle in the longitudinal direction DL configured to produce the precise movement of said point of the bridge 11 in the longitudinal direction DL when rotates. The rotation of said screw or spindle can be manual or automatic. It is further proposed to attach the bridge 11 to the second sub-chassis 1*b* by fixation screws directed in the perpendicular direction DP, so that different gauges can be interleaved between the bridge 11 and the second sub-chassis 1*b* to modify the position of that point of the bridge 11 in the perpendicular direction DP.

The example shown in FIG. 8 shows a schematic mechanism making up an adjustment device 20 providing three degrees of freedom in the three directions, i.e., transverse direction DT, longitudinal direction DL, and perpendicular direction DP, by three successively connected mechanisms 21, each providing one degree of freedom.

In this example, each mechanism consists of a servomotor 23 connected to a spindle 22, the spindle being arranged parallel to the transverse direction DT, longitudinal direction DL, or perpendicular direction DP.

There is attached to the spindle 22 a threaded element which will move axially along the spindle 22 as said spindle 22 rotates.

If more than one mechanism 21 is included, the successive mechanisms 21 are suspended from the threaded elements of the preceding mechanisms, forming a chain of mechanisms, each determining a movement in one of the directions, such that the actuation of one mechanism 21 causes the movement of all the successive mechanisms 21 in one direction.

A first mechanism 21 will be connected to the chassis 1, for example, and the last mechanism 21 of the chain of mechanisms 21 will have the corresponding threaded element connected to the bridge 11. Obviously, a reverse construction is also possible.

In the example shown in this drawing, a first mechanism 21 is held on the chassis 1 by clamps with bearings surrounding the ends of a spindle 22 which is parallel to the perpendicular direction DP.

The threaded element of the first mechanism 21 is attached to a support holding a second mechanism 21 identical to the first mechanism 21 but having the corresponding spindle 22 oriented in a direction parallel to the transverse direction DT.

The threaded element of the second mechanism 21 is attached to a support holding a third mechanism 21 identical to the first and second mechanisms 21 but having the corresponding spindle 22 oriented in a direction parallel to the longitudinal direction DL. The threaded element of the third mechanism 21 is connected to the bridge 11.

The precise and coordinated actuation of the three mentioned mechanisms 21 making up the adjustment device 20 will allow moving an end of the bridge 21 in any of the three directions, i.e., transverse direction DT, longitudinal direction DL, or perpendicular direction DP, and the precise movement of both ends of the bridge 11 will also allow introducing rotations to the bridge 11 in at least two additional degrees of rotational freedom.

Obviously, it will be understood that this is a schematic embodiment and that the adjustment device 20 may be different, or may include other movement transmission mechanisms, for example, those based on gears, in addition to including other supplementary elements as guide elements to assure a correct movement in each of the directions.

To achieve a correct alignment of the digital ink jet print heads 14 of the multiple printing units 10, it is proposed for the servomotors 23 of all the adjustment devices 20 to be controlled through a control device.

Said control device will receive information through a first or second measuring device 31, 32 which allow determining the deviations existing in the position of each digital ink-jet print head 14, as well as calculating the control orders required for controlling the necessary adjustment devices 20 in order to correct said detected deviations.

FIGS. 1, 2, and 3 show a second measuring device 32 in the form of an optical sensor or a camera located downstream of the printing units 10 and directed towards the sheet material 4. In this embodiment, said optical sensor or camera will be the aforementioned second measuring device 32.

The optical sensor or camera will capture images of the motifs printed on the sheet material 4, sending said images to the control system. Said control system will process the images, detecting any misalignment between the different colors printed by the different printing units 10, for example, observing print marks or misalignments existing between the colors of the images.

The misalignment between the printed colors will correspond with misalignments of the digital ink jet print heads 14 to be corrected. Based on that information, the control system will generate control orders to be transmitted to the adjustment devices 20, correcting the position of each of the bridges 11 and of the corresponding printing units 10.

According to an additional embodiment shown in FIG. 7, the second measuring device 32 will consists of position sensors, for example laser meters, which will precisely measure the position of each of the digital ink jet print heads 14, such that they allow detecting any deviation existing in the actual position of each digital ink-jet print head 14 with respect to a pre-established ideal position stored in the control system, or with respect to other successive ink-jet print heads, which allows generating the control orders for the adjustment devices 20 from said information.

The control system can consist of one or more computers, programmable logic controllers, or other similar devices.

FIG. 7 also illustrates an embodiment of the first measuring device 31, which is shown in this embodiment as a laser meter that precisely measures the distance between each ink jet print head 14 and the corresponding printing segment 6.

According to an alternative or additional embodiment, the digital printing machine can also include an image detector 36, such a camera or a video camera, facing the freshly printed surface of the band of sheet material downstream from the printing segments 6, as shown on FIGS. 1*a*, 1*b*, 2*a*, 2*b*, 3*a* and 3*b*.

This image detector 36 capture images from the motifs printed on the surface of the band of sheet material and send said images to the control unit 30. The control unit 30 analyzes said captured images and determine if a rubbing printing defect and/or if an ink jet obturation printing defect exist on said captured images, and which colors are affected by said detected defects.

This determination performed by the control unit 30 can be obtained, for example, by comparing the captured images with a digital image containing the motif to be printed or containing the motif to be printed on each color. Any difference between the captured image and the stored digital image will be considered a printing defect.

A programed or trained algorithm executed by said control unit 30 can further determine which type of defect has been detected.

Said control unit 30 will also be aware of the color in which the ink jet printing heads contained in each printing unit 10 are printing, for example because this information has been previously stored in the control unit 30.

Comparing the information obtained relative to which color suffers from a printing defect with the information relative to which printing unit 10 prints on each color, the control unit 30 can determine which printing unit 10 comprises the ink jet printing units 14 responsible of the detected printing defect, permitting the control unit 30 to actuate only on the affected printing unit 10 to solve the detected printing problem, for example increasing the distance between the printing segment 6 and the printing unit 10 responsible from this particular problem, even without interrupting the printing process, of moving the printing unit 10 affected with the detected problem to the maintenance position, where a cleaning operation can be performed.

It is also considered to include multiple first sub-chassis 1*a* each supporting only a portion of the supports adjacent some of the printing segments 6, and each being movable independently by a first actuator 1*c*, permitting to adjust the distance between each printing segment 6 and the correspondent printing unit 10 independently.

It will be understood that the different parts making up the invention described in one embodiment can be freely combined with the parts described in other different embodiments even though said combination has not been explicitly described, provided that said combination is not detrimental to the invention.

The invention claimed is:

1. An ink-jet printing heads protection system in a digital printing machine, the system comprising:

a plurality of printing units, each comprising one bridge with linear guides and a carriage including a group of ink-jet printing heads slidably connected to the linear guides, the bridge being supported above a band path transversely to two side edges of the band path, the linear guides including a first portion located above the band path between the side edges thereof and a second portion extending beyond one side edge of the band path, the carriage being actuated by a second actuator configured to move the carriage along the linear guides between an operative position, where the ink-jet printing heads are above the band path facing a printing segment thereof, and a maintenance where the carriage is in the second portion of the linear guides and the ink-jet print heads are non-opposed to the band path permitting access to the ink-jet print heads from bellow for maintenance without interrupting the printing process of other printing units in the operative position;

a chassis comprising a first sub-chassis and a second sub-chassis, the first sub-chassis supporting one or more supports defining the band path as an arched band path or as a polygonal band path for guiding a sheet material in a taut manner, and the second sub-chassis supporting the plurality of printing units, the first sub-chassis being moveable by a first actuator between a printing position where the printing segments of the band path are spaced apart less than 5 mm from the ink-jet print heads of the carriages placed in the operative position, and a secure position in which the distance between the printing segments and the ink jet print heads of the carriages placed in the operative position is bigger than in the printing position;

a thickening presence signal generator configured to generate a thickening presence signal when a thickening of the sheet material approaches the printing units in a conveyance direction;

the first actuator is connected to the thickening presence signal generator and is configured to move the first sub-chassis from the printing position to the secure position in response to the thickening presence signal;

each bridge includes a first anchoring point attached to the second sub-chassis through an adjustment device and a second anchoring point attached to the second sub-chassis through an articulation or through another adjustment device, each adjustment device being configured to provide a precisely moving the anchoring point connected thereto for correctly aligning the bridge with respect to the corresponding printing segment and with respect to the other bridges of other plurality of printing units.

2. The ink-jet printing heads protecting system according to claim 1 wherein the thickening presence signal generator is selected among:

a thickening detector configured to detect a thickening of the sheet material placed in a first position upstream of the printing units in the conveyance direction; and/or a metering device configured to determine a correspondence between a given portion of the sheet material placed in a first position upstream of the printing units in the conveyance direction and a pre-stored thickening position data; and/or a thickener device configured to create a thickening on the sheet material in a first position upstream of the printing units in the conveyance direction.

3. The ink-jet printing heads protection system according to claim 2 wherein the thickener device is an automatic splicer configured to adhere one final end of one partial band of sheet material to one initial end of another successive partial band of sheet material to create the continuous band of sheet material, creating a thickened splice.

4. The ink-jet printing heads protection system according to claim 2 wherein the thickening detector is selected among:

an optical detector directed towards the band of sheet material;

a thickness meter for metering the thickness of the band of sheet material;

a roughness detector in contact with at least one face of the band of sheet material.

5. The ink-jet printing heads protection system according to claim 1 wherein the one or more supports are a single rotary roller defining the arched band path thereon, or a plurality of parallel rotary rollers defining the polygonal arched band path thereon, each printing segment is defined coincident with a single rotary roller, or each printing segments is defined between two successive rotary rollers.

6. The ink-jet printing heads protecting system according to claim 1 wherein the digital printing machine further comprises an image detector facing a freshly printed surface of the band of sheet material downstream from the printing segments configured to capture images thereof and configured to send the captured images to a control unit, the control unit is configured to perform an automatic analysis of the captured images to detect rubbing printing defects and/or ink-jet obturation printing defects, and the control unit is configured to activate the first actuator to move the first sub-chassis away from the ink-jet print heads and/or to move printing units from the operative position opposed to a printing segment to the maintenance position in response to the detection of rubbing printing defects and/or ink-jet obturation printing defects.

7. The ink-jet printing heads protecting system according to claim 6 wherein the control unit comprises stored data with ink-color information of an ink-color printed by each of the ink-jet print heads of each printing unit, and the control unit is configured to determine ink-color information of the rubbing printing defects and/or ink-jet obturation printing defects in the captured image and, considering the stored ink-color information and the deemed ink-color of the defects, to determine the printing unit printing with the rubbing printing defects and/or ink-jet obturation printing defect, and the control unit being further configured to activate the first actuator and/or the second actuator to move the first sub-chassis away from the ink-jet print heads, and/or to move printing units from a position opposed to a printing segment to the maintenance position in response to the detection of rubbing printing defects and/or ink-jet obturation printing defects.

* * * * *